US009475313B2

(12) United States Patent
Ebihara et al.

(10) Patent No.: US 9,475,313 B2
(45) Date of Patent: Oct. 25, 2016

(54) PRETREATMENT LIQUID APPLICATION DRYING DEVICE, PRINTING SYSTEM INCLUDING THE SAME, AND PRINTING DEVICE

(71) Applicants: Takashi Ebihara, Ibaraki (JP); Kuraichi Fukaya, Ibaraki (JP); Yutaka Nagasawa, Chiba (JP); Shinji Nagayama, Ibaraki (JP)

(72) Inventors: Takashi Ebihara, Ibaraki (JP); Kuraichi Fukaya, Ibaraki (JP); Yutaka Nagasawa, Chiba (JP); Shinji Nagayama, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/960,558

(22) Filed: Dec. 7, 2015

(65) Prior Publication Data

US 2016/0167401 A1 Jun. 16, 2016

(30) Foreign Application Priority Data

Dec. 12, 2014 (JP) ..... 2014-251518

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC ..... B41J 1/002
See application file for complete search history.

(56) References Cited

U.S. PATENT DOCUMENTS

2014/0232797 A1* 8/2014 Onodera ..... B41F 23/042 347/102
2015/0346659 A1 12/2015 Nagayama et al.

FOREIGN PATENT DOCUMENTS

| | | |
|---|---|---|
| JP | H11-138928 | 5/1999 |
| JP | 2006-076270 | 3/2006 |
| JP | 2012-035566 | 2/2012 |
| JP | 2015-128876 | 7/2015 |

* cited by examiner

*Primary Examiner* — Stephen Meier
*Assistant Examiner* — Alexander D Shenderov
(74) *Attorney, Agent, or Firm* — Ipusa, PLLC

(57) ABSTRACT

A pretreatment liquid application drying device includes a conveying unit configured to convey a continuous recording medium; an application device configured to apply a pretreatment liquid on the recording medium; a heating drying device disposed at a downstream side of the application device in a recording medium conveying direction, including first and second drying units that are connected in a separable manner, the first and second drying units respectively configured to dry one side and the other side of the recording medium; and a cockling suppressing mechanism configured to curve the heated recording medium in the conveying direction, the cockling suppressing mechanism being provided on at least one of an upstream and a downstream side in the conveying direction near the heating drying device. A part of the cockling suppressing mechanism moves in conjunction with a separating and connecting movement of the heating drying device.

9 Claims, 17 Drawing Sheets

PRETREATMENT LIQUID APPLICATION DRYING DEVICE, PRINTING SYSTEM INCLUDING THE SAME, AND PRINTING DEVICE

BACKGROUND OF THE INVENTION

1. Field of the Invention

The present invention relates to a pretreatment liquid application drying device, a printing system including the same, and a printing device.

2. Description of the Related Art

The image recording method of the inkjet method has rapidly become widespread, according to advantages such as low noise, low running cost, and the ease of forming color images. However, when images are recorded onto a medium other than exclusive-use paper, there have been initial quality problems in, for example, blurring, density, color tone, show-through, etc., and also problems relevant to the robustness of the image such as water resistance and weather resistance. Therefore, various proposals have been made for solving these problems.

As one means for solving these problems, there is a method of improving the image quality by applying a pretreatment liquid having a function of agglutinating the ink immediately before ink droplets adhere to a sheet that is a recording medium. When the pretreatment liquid is applied, there is a need to dry the sheet before discharging the ink onto the sheet. At this time, when a continuous paper sheet is used as the sheet, cockling may occur, i.e., ripples may be formed in the sheet.

Here, Patent Document 1 discloses a method of preventing cockling. Specifically, during the printing operation, after the ink adheres to the sheet, the sheet is dried, and then a seasoning device is used to spray heated moisture onto the sheet by air blasting, to prevent cockling.

However, the method of Patent Document 1 includes a plurality of processes, and therefore the device is complex and large-scale.

Furthermore, in a device that uses a continuous paper sheet as the sheet, a member for assisting the operation of conveying the sheet (a conveying belt, etc.) may not be provided. In the case of such a device, when a sheet needs to be set to exchange the sheet type or because the device is out of paper, the device needs to be opened to pass the sheet through the device.

Patent Document 1: Japanese Laid-Open Patent Publication No. 2012-035566

SUMMARY OF THE INVENTION

The present invention provides a pretreatment liquid application drying device, a printing system including the same, and a printing device, in which one or more of the above-described disadvantages are eliminated.

According to an aspect of the present invention, there is provided a pretreatment liquid application drying device including a conveying unit configured to convey a recording medium that is a continuous sheet; an application device configured to apply a pretreatment liquid on the recording medium conveyed by the conveying unit; a heating drying device disposed at a downstream side of the application device in a conveying direction of the recording medium, the heating drying device including a first drying unit and a second drying unit that are connected with each other in a separable manner, the first drying unit including a first heating unit configured to dry one side of the recording medium and the second drying unit including a second heating unit configured to dry another side of the recording medium; and a cockling suppressing mechanism configured to curve the heated recording medium a plurality of times in the conveying direction, the cockling suppressing mechanism being provided on at least one of an upstream side and a downstream side in the conveying direction near the heating drying device, wherein a part of the cockling suppressing mechanism moves in conjunction with a separating and connecting movement of the heating drying device.

According to an aspect of the present invention, there is provided a printing device including a conveying part configured to convey a recording medium; a recording device part configured to discharge ink on the recording medium such that the ink adheres on the recording medium; a heating drying device part disposed at a downstream side of the recording device part in a conveying direction of the recording medium, the heating drying device part including a first drying unit and a second drying unit that are connected with each other in a separable manner, the first drying unit including a first heating unit configured to dry one side of the recording medium and the second drying unit including a second heating unit configured to dry another side of the recording medium; and a cockling suppressing mechanism part configured to curve the recording medium a plurality of times in the conveying direction, the cockling suppressing mechanism part being provided on at least one of an upstream side and a downstream side in the conveying direction near the heating drying device part, wherein a part of the cockling suppressing mechanism part moves in conjunction with a separating and connecting movement of the heating drying device part.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

<First Embodiment>

(Overall Configuration of Inkjet Printer)

Figure 1:
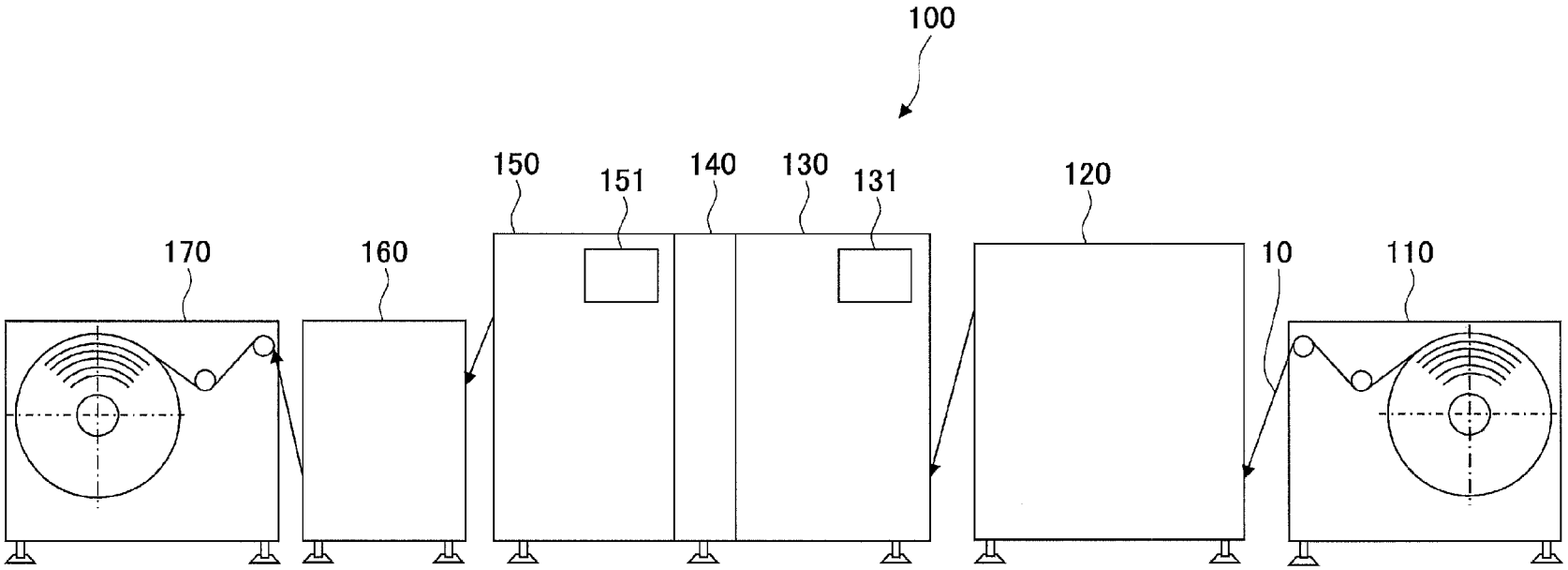
FIG. 1 illustrates an example of a schematic configuration of a printing system according to a first embodiment of the present invention.

FIG. 1 illustrates an example of a schematic configuration of a printing system 100 according to a first embodiment of the present invention. As illustrated in FIG. 1, the printing system 100 includes a sheet feeding device 110, a pretreatment liquid application drying device 120, a first inkjet printer 130, a reversing device 140, a second inkjet printer 150, a post drying device 160, and a posttreatment device 170. The first inkjet printer 130 and the second inkjet printer 150 are recording devices for performing printing by discharging ink.

In FIG. 1, a continuous recording medium 10, which is, for example, a long, continuous sheet reeled out from the sheet feeding device 110, is first sent to the pretreatment liquid application drying device 120.

At the pretreatment liquid application drying device 120, pretreatment is performed before the next process of image recording by an inkjet method on one side or both sides of the sheet for suppressing blurring or show-through of discharged ink. The pretreatment includes applying a pretreatment liquid such as a restrainer, on one side or both sides of the recording medium 10. Furthermore, in the pretreatment liquid application drying device 120, the recording medium 10 is conveyed while the pretreatment liquid on the recording medium 10 is being dried.

The recording medium 10, which has undergone the processes of applying and drying the pretreatment liquid, is next sent to the first inkjet printer 130, where a head unit 131 discharges ink droplets on the front side of the recording medium 10 to form a desired image. Subsequently, the front and back sides of the recording medium 10 are reversed by the reversing device 140, which partially includes a drying function such as a dryer. Then, the recording medium 10 is sent to the second inkjet printer 150, where a head unit 151 discharges ink droplets on the back side of the recording medium 10 to form a desired image.

Then, after printing has been performed on both sides of the recording medium 10, a post-drying process is performed at the post drying device 160, mainly by heated air from a dryer. Subsequently, the recording medium 10 is sent to the posttreatment device 170, where a predetermined posttreatment and winding-up are performed.

The elements of the printing system 100 according to the present embodiment are operably connected to a control system, and signals relevant to a printing operation, etc., are input to the elements.

(Pretreatment Liquid Application Drying Device)

Figure 2:
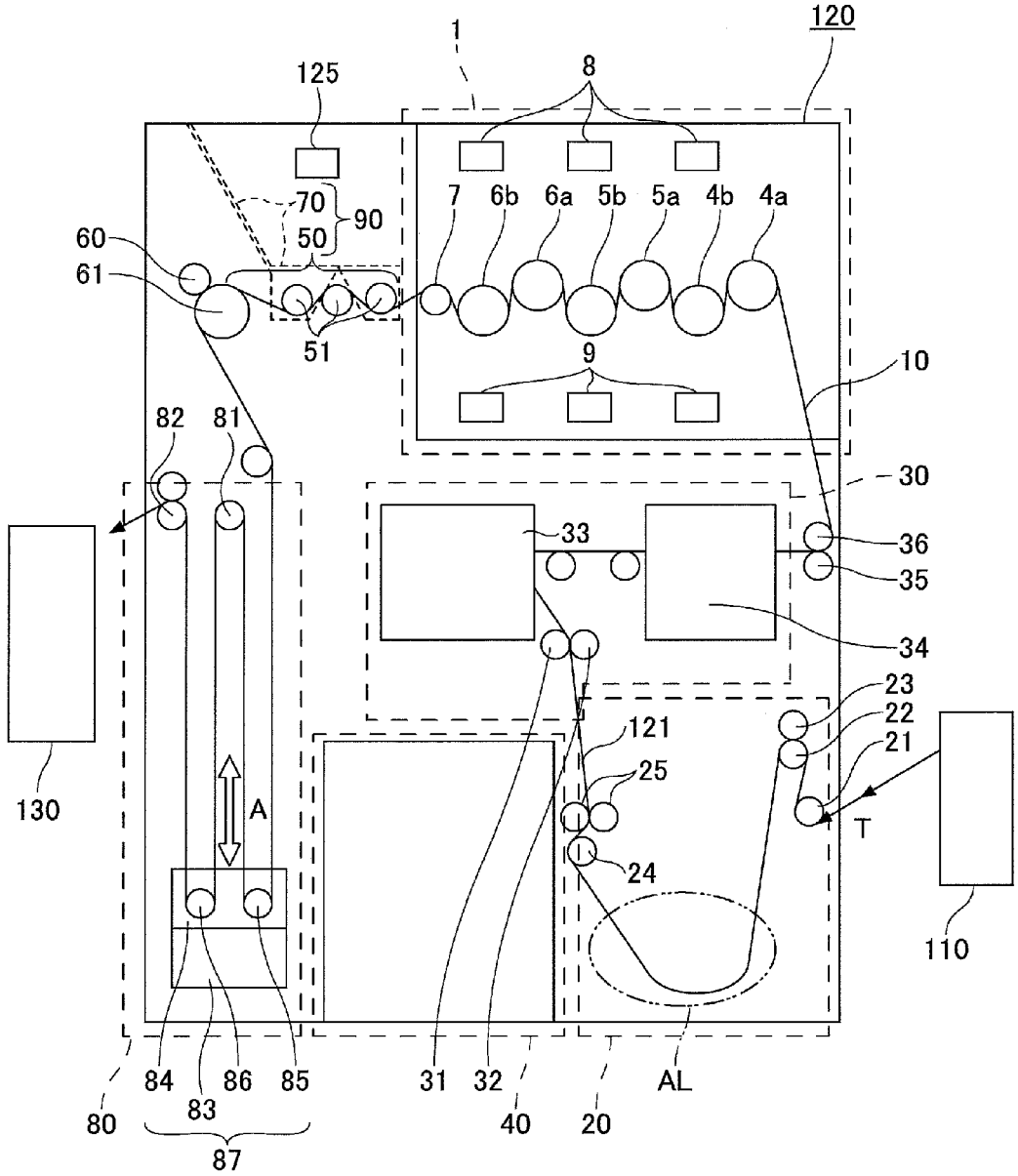
FIG. 2 is a schematic configuration diagram of a pretreatment liquid application drying device included in the printing system of FIG. 1.

Next, with reference to FIGS. 2 through 5, a description is given of the pretreatment liquid application drying device 120. FIG. 2 is a schematic configuration diagram of the pretreatment liquid application drying device 120, indicating a state when application drying conveyance is performed.

Figure 3:
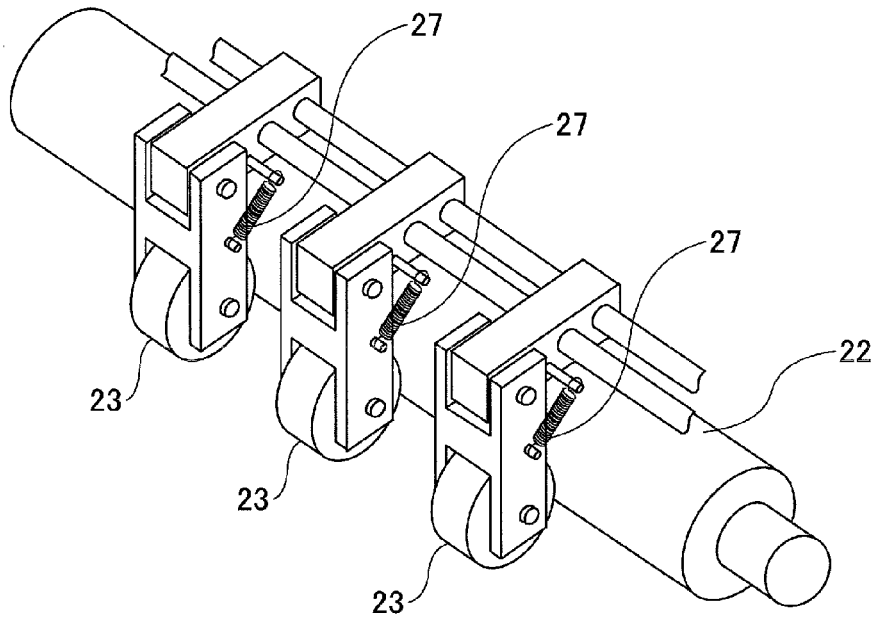
FIG. 3 is a configuration diagram near a feed-in roller, which is for drawing in a recording medium from a sheet feeding device, inside the pretreatment liquid application drying device of FIG. 2.
Figure 4:
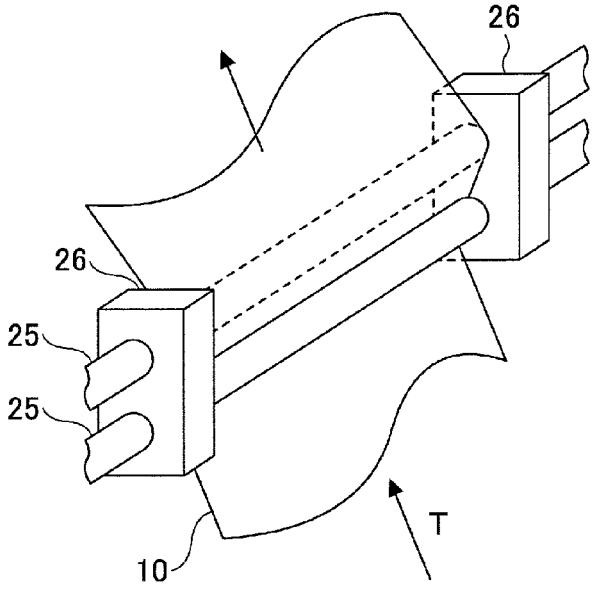
FIG. 4 is a configuration diagram of a part near pass shafts inside the pretreatment liquid application drying device of FIG. 2, to which the recording medium is conveyed after forming an air loop where the position of the recording medium is corrected.
Figure 5:
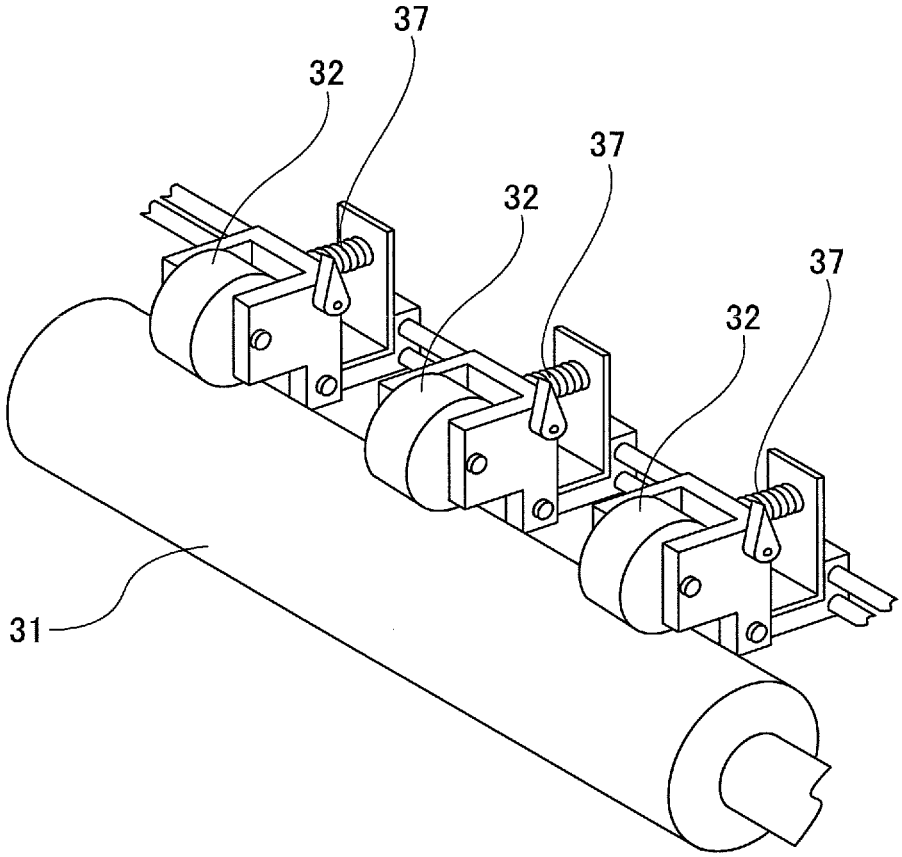
FIG. 5 is for describing the conveyance of the recording medium in an in-feed roller part inside the pretreatment liquid application drying device of FIG. 2.

FIG. 3 is a configuration diagram near a feed-in (FI) roller 22 inside the pretreatment liquid application drying device 120. The FI roller 22 is for drawing in the recording medium 10 from the sheet feeding device 110. FIG. 4 is a configuration diagram of a part near pass shafts 25 inside the pretreatment liquid application drying device 120. The recording medium 10 is conveyed to the pass shafts 25 after forming the air loop AL where the position of the recording medium 10 is corrected. FIG. 5 is for describing the conveyance of the recording medium in an in-feed roller part inside the pretreatment liquid application drying device 120 of FIG. 2. By the configurations illustrated in FIGS. 3 through 5, tension is applied to the recording medium 10 that is a continuous sheet, inside the pretreatment liquid application drying device 120.

The pretreatment liquid application drying device 120 illustrated in FIG. 2 includes a pretreatment liquid application device 30 for applying a pretreatment liquid on the recording medium 10. In order to dry the pretreatment liquid on the recording medium 10, a heating drying unit (heating drying device) 1 is provided on the downstream side of the pretreatment liquid application device 30 in the recording medium conveying direction. Furthermore, the pretreatment liquid application drying device 120 includes an air loop unit 20, a pretreatment liquid supply unit 40, a cockling suppressing mechanism 90, and a dancer device 80, in addition to the pretreatment liquid application device 30 and the heating drying device 1 described above.

The operations of the devices and units inside the pretreatment liquid application drying device 120 are controlled by a control unit 125. Note that the control unit 125 may be disposed anywhere inside the pretreatment liquid application drying device 120, or the control unit 125 may be disposed outside the pretreatment liquid application drying device 120 together with a control system, and the control unit 125 may control the devices and units by signals, etc.

In FIG. 2, multiple guide rollers 21, 24, etc., which are rotatable and which have bearings at the edges of the rollers, are disposed inside the pretreatment liquid application drying device 120. The guide rollers 21, 24, etc., form a conveying path 121 of the recording medium 10.

The reference numeral 22 denotes an FI roller that is drivingly rotated by a driving source such as a motor. As illustrated in FIG. 3, to the FI roller 22, tension is applied as FI nip rollers 23 are pressed against the FI roller 22 by the tensile force of the springs 27.

The recording medium 10 is elastically sandwiched by the FI roller 22 and the FI nip rollers 23, and as the FI roller 22 is rotated by the above-described driving source, the recording medium 10 can be drawn into pretreatment liquid application units 33, 34 from the sheet feeding device 110 that is disposed at a previous stage.

Furthermore, the recording medium 10, which has been sent out from the FI roller 22 and the FI nip rollers 23, is slightly slackened to form the air loop AL. The slackening amount in the air loop AL is monitored by an optical sensor, and the FI roller 22 is drivingly controlled such that the slackening amount becomes fixed.

After forming the air loop AL, the recording medium 10 passes through between the pass shafts 25 and edge guides 26 as illustrated in FIG. 4, and forms an S-shape as the recording medium 10 passes through the two pass shafts 25 which are disposed in a direction orthogonal to the convey direction (direction of arrow T) of the recording medium 10. A pair of edge guides 26 are supported by the pass shafts 25, and the interval between the edge guides 26 is the same as the size of the recording medium 10 in the width direction.

Therefore, by the functions of the pass shafts 25 and the edge guides 26, the moving position of the recording medium 10 in the width direction is restricted, such that the recording medium 10 can move in a stable manner. Note that the edge guides 26 are fixed to the pass shafts 25 by, for example, fixing units such as screws, and the positions of the edge guides 26 can be adjusted according to the width size of the recording medium 10 being used. To the recording medium 10 that has passed through between the pass shafts 25 and the edge guides 26, tension is applied by tension shafts that are in a fixed state, so that the recording medium 10 moves in a stable manner.

The recording medium 10, which has passed through the tension shafts, enters the pretreatment liquid application device 30, and passes through between an in-feed roller 31 and feed nip rollers 32, which are drivingly rotated by a driving source such as a motor. As illustrated in FIG. 5, there are a plurality of feed nip rollers 32 disposed along the axial direction of the in-feed roller 31. Each of the feed nip rollers 32 is pressed against the in-feed roller 31 by a spring 37.

The recording medium 10, which has passed through between the in-feed roller 31 and the feed nip rollers 32, sequentially passes through the back side application device unit 33 for applying the pretreatment liquid on the back side and the front side application device unit 34 for applying the pretreatment liquid on the front side. Accordingly, pretreatment liquid is applied on both sides of the recording medium 10.

The recording medium 10, which has passed through the front side application device unit 34, passes through between an out-feed roller 35 and feed nip rollers 36 that are drivingly rotated by a driving source such as a motor. The out-feed roller 35 and the feed nip rollers 36 are similar to the in-feed roller 31 and the feed nip rollers 32 illustrated in FIG. 5.

Subsequently, the recording medium 10 passes through the heating drying device 1, and then passes through a curved conveying path 52 (FIG. 6) that extends along driven rollers 51, as a cockling suppressing unit 50 inside the cockling suppressing mechanism 90 for suppressing cockling, particularly in the standby state.

Then, the recording medium 10 passes through between a feed roller 61 and feed nip rollers 60 that are drivingly rotated by a driving source such as a motor. The feed roller 61 and the feed nip rollers 60 are similar to the in-feed roller 31 and the feed nip rollers 32 illustrated in FIG. 5. Subsequently, the recording medium 10 is wound around rotatable dancer rollers 85, 86, and a guide roller 81 disposed between the dancer rollers 85, 86, so as to form a W-shape.

The dancer rollers 85, 86 are rotatably attached to a movable frame 84 via bearings disposed at the edges of the rollers, thereby forming a dancer unit 87. Note that a weight 83 is attached to the movable frame 84. The dancer unit 87 is movable along a gravity direction A. A dancer unit position detecting unit for detecting the position of the dancer unit 87 is provided. According to the output of the position detecting unit, the driving source of the feed roller 61 is drivingly controlled. By the above configuration, the position of the dancer unit 87 can be adjusted, and the buffer amount of the recording medium 10 between devices is secured.

After the recording medium 10 passes through an eject roller 82, the recording medium 10 is conveyed to the first inkjet printer 130 at the subsequent stage.

By the above configuration, in the pretreatment liquid application drying device 120, the pretreatment liquid application device 30 applies pretreatment liquid on the recording medium 10. The pretreatment liquid is for improving the image quality, by preventing blurring of ink and assisting the permeation of ink. Subsequently, the pretreatment liquid is evaporated in the heating drying device 1. The recording medium 10 then passes through the cockling suppressing unit 50, and the recording medium 10 is cooled by the dancer device 80 that conveys the recording medium 10 in steps having different heights. Subsequently, the recording medium 10 is conveyed to the first inkjet printer 130 at the subsequent stage.

In FIG. 2, the feed rollers 31, 35, 61, etc., function as a conveying unit of the pretreatment liquid application drying device 120.

(Heating Drying Device and Cockling Suppressing Mechanism)

Figure 6:
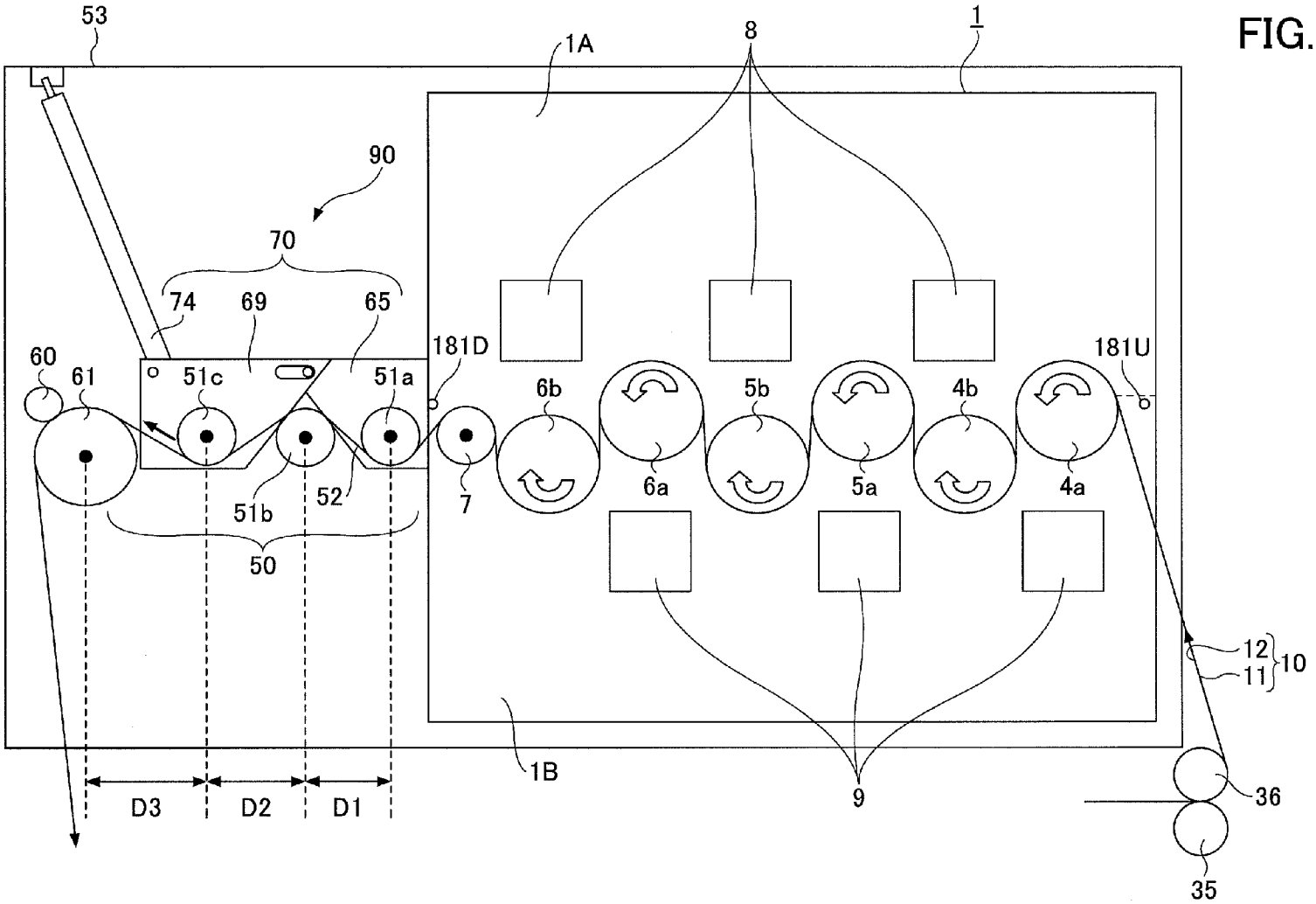
FIG. 6 illustrates a schematic configuration near a heating drying device that has formed a curved conveying path for suppressing cockling immediately after heating and drying.

FIG. 6 illustrates a schematic configuration of the heating drying device 1 and the cockling suppressing mechanism 90 according to the first embodiment of the present invention. The heating drying device 1 dries the recording medium 10 on which the pretreatment liquid has been applied. The heating drying device 1 includes a front side drying unit 1A at the top part and a back side drying unit 1B at the bottom part. The cockling suppressing mechanism 90 includes a cockling suppressing unit 50 and a link mechanism 70.

The front side drying unit 1A at the top part includes front side drying heating rollers 4*b*, 5*b*, 6*b* for drying a front side 11 of the recording medium 10, and a plurality of front side vapor ejection fans (exhaust ducts) 8 for ejecting vapor, etc. Similar to the front side drying unit 1A at the top part, the back side drying unit 1B at the bottom part includes a plurality of back side drying heating rollers 4*a*, 5*a*, 6*a* for drying a back side 12 of the recording medium 10, and a plurality of back side vapor ejection fans 9 for ejecting vapor, etc. Furthermore, an idler roller 7 for assisting the ejection of the recording medium 10 is disposed inside the heating drying device 1, by being fixed to a frame 53 (see FIGS. 8 and 10) outside the heating drying device 1.

The heating rollers 4*a* through 6*b* are driven rollers for the purpose of simplifying the device and the control, and the heating rollers 4*a* through 6*b* each include a heater for heating (heater lamp) and a heap pipe for temperature homogenization. Note that the surfaces of the heating rollers 4*a* through 6*b* are coated by a non-viscous film, such as fluorocarbon resin. By this coating, it is possible to suppress the adhesion of ink, etc., on the surface roller, and to suppress the decrease in the efficiency of heat conduction to the recording medium 10 caused by adhering matter on the roller surface.

Figure 18:
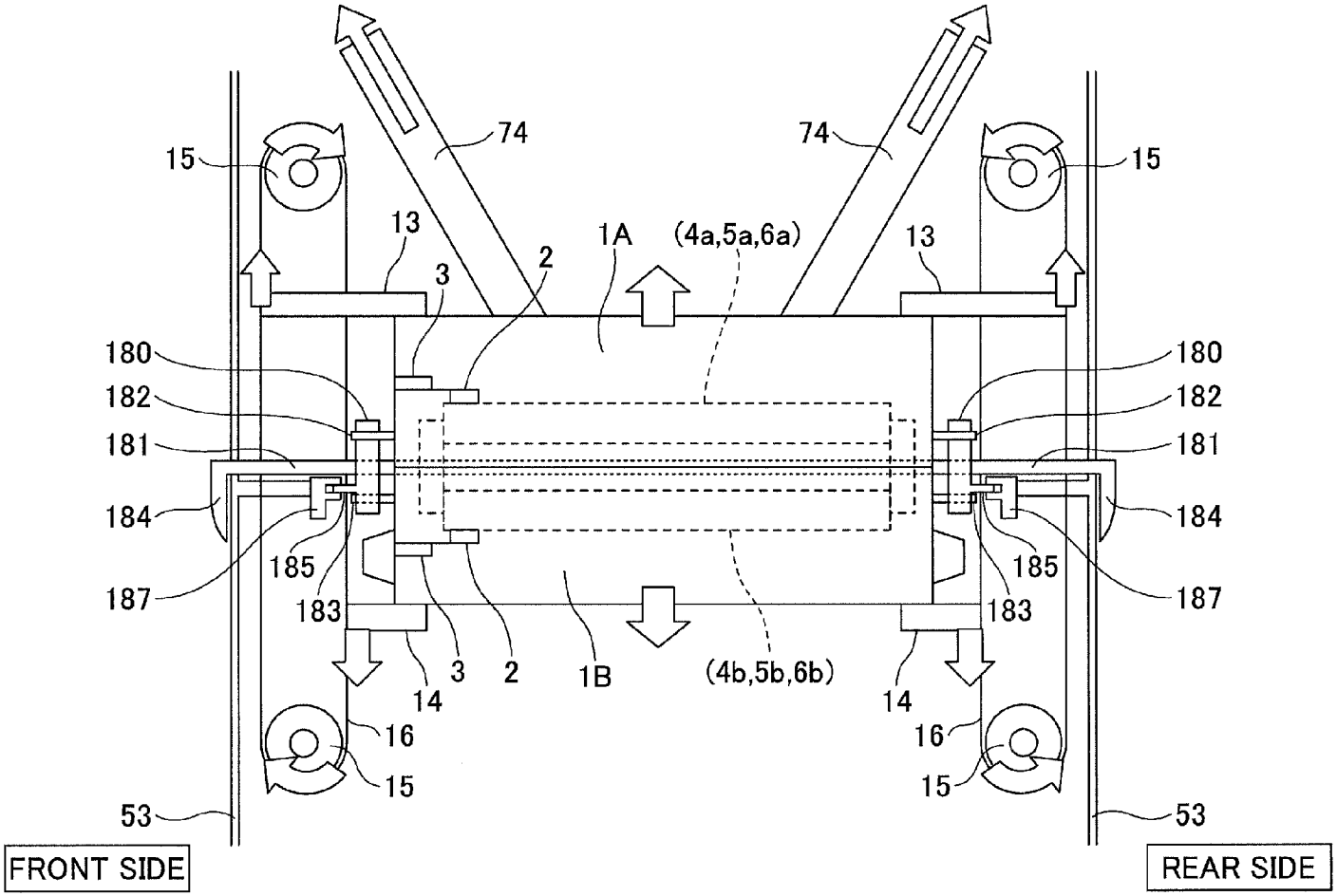
FIG. 18 is a schematic diagram illustrating a method of opening and closing the heating drying device, which is a view of the heating drying device of FIG. 6 from the recording medium conveying direction.

In the heating drying device 1, the control unit 125 of the pretreatment liquid application drying device 120 executes a heating control process, and controls the heating amount (temperature) of the respective heaters (heater lamps, etc.) disposed in the heating rollers 4*a* through 6*b*, based on detection results by the temperature sensor (thermistor 2, see FIG. 18).

Here, in the heating drying device 1, with respect to the recording medium 10 on which the pretreatment liquid has been applied, basically only dries the side on which the pretreatment liquid is applied (both or one of the front and back sides) is dried. That is, when the pretreatment liquid is applied only on the front side, only the front side 11 is dried, and therefore the front side drying heating rollers 4*b*, 5*b*, 6*b* are heated to dry the recording medium 10. When the pretreatment liquid is applied only on the back side, only the back side 12 is dried, and therefore the back side drying heating rollers 4*a*, 5*a*, 6*a* are heated to dry the recording medium 10. Furthermore, when the pretreatment liquid is applied on both sides, both sides of the recording medium 10 is dried, and therefore the front side drying heating rollers 4*b*, 5*b*, 6*b* and the back side drying heating rollers 4*a*, 5*a*, 6*a* are heated to dry the recording medium 10.

Furthermore, at the time of printing, the temperature of the respective heating rollers 4*a* through 6*b* is set such that the temperature gradually rises from the upstream side to the downstream side. Accordingly, a rapid temperature rise is avoided at the first heating rollers 4*a*, 4*b* into which the recording medium 10 enters. Therefore, the heat load applied on the recording medium 10 is effectively suppressed, and damages such as ripples and deformation in the recording medium 10 caused by the heat load are reduced.

For example, the heating temperature of the heating rollers 4*a* through 6*b* is set within a range of, for example, 50° C. through 90° C., which is higher than room temperature. Furthermore, the heating temperature may be set to change in time series in conjunction with the printing operation. Furthermore, when the recording medium 10 is thick, or in a cold environment, the temperature of the heating rollers 4*a* through 6*b* may be set to be at an even higher temperature (to approximately 100° C.) for drying the pretreatment liquid.

However, in the heating drying device and near the heating drying device, there have been cases where the heating rollers cause cockling in the recording medium, which are curls that of heat plastic deformation, in a standby state when printing is stopped, due to the difference in the temperature and humidity between the heating drying device and the outside air. Particularly, the recording medium 10, which is rapidly dried in the heating drying device 1, starts to rapidly absorb moisture immediately after exiting the outlet of the heating drying device 1, which causes a significant cockling phenomenon. There have been cases where this deformation of the recording medium, which is a large curl, contacts the head of the subsequent printer at the time of printing, causing the head to be clogged or damaged.

Thus, in the present embodiment, a plurality of driven rollers 51 are arranged in the conveying direction as the cockling suppressing unit 50, on the downstream side near the outlet of the heating drying device 1, such that the curved conveying path 52 is formed in the conveying direction, which includes a plurality of curves. Furthermore, also on the inlet side, a curved conveying path may be provided, such that waves are formed in a direction perpendicular to the slanted conveying direction.

In the curved conveying path 52 formed by a plurality of hollow driven rollers 51, the inter-axial distances between adjacent driven rollers, are preferably set to be shorter at positions closer to the heating drying device 1 (D3>D2>D1). For example, the driven roller 51 at the outlet side of the heating drying device 1 is set as the starting point, the inter-axial distances between the driven rollers 51 on the downstream side of this starting point are sequentially set to be 50 mm, 75 mm, 100 mm, and then all distances beyond this are set to be 100 mm.

By the above configuration, in the recording medium 10, it is possible to mitigate the occurrence of cockling, which is a ripple-shaped deformation in a direction parallel to the conveying direction and a perpendicular direction with respect to the width direction (sheet width) of the recording medium 10, during the standby time.

(Configuration Example of Driven Rollers)

Figure 7:
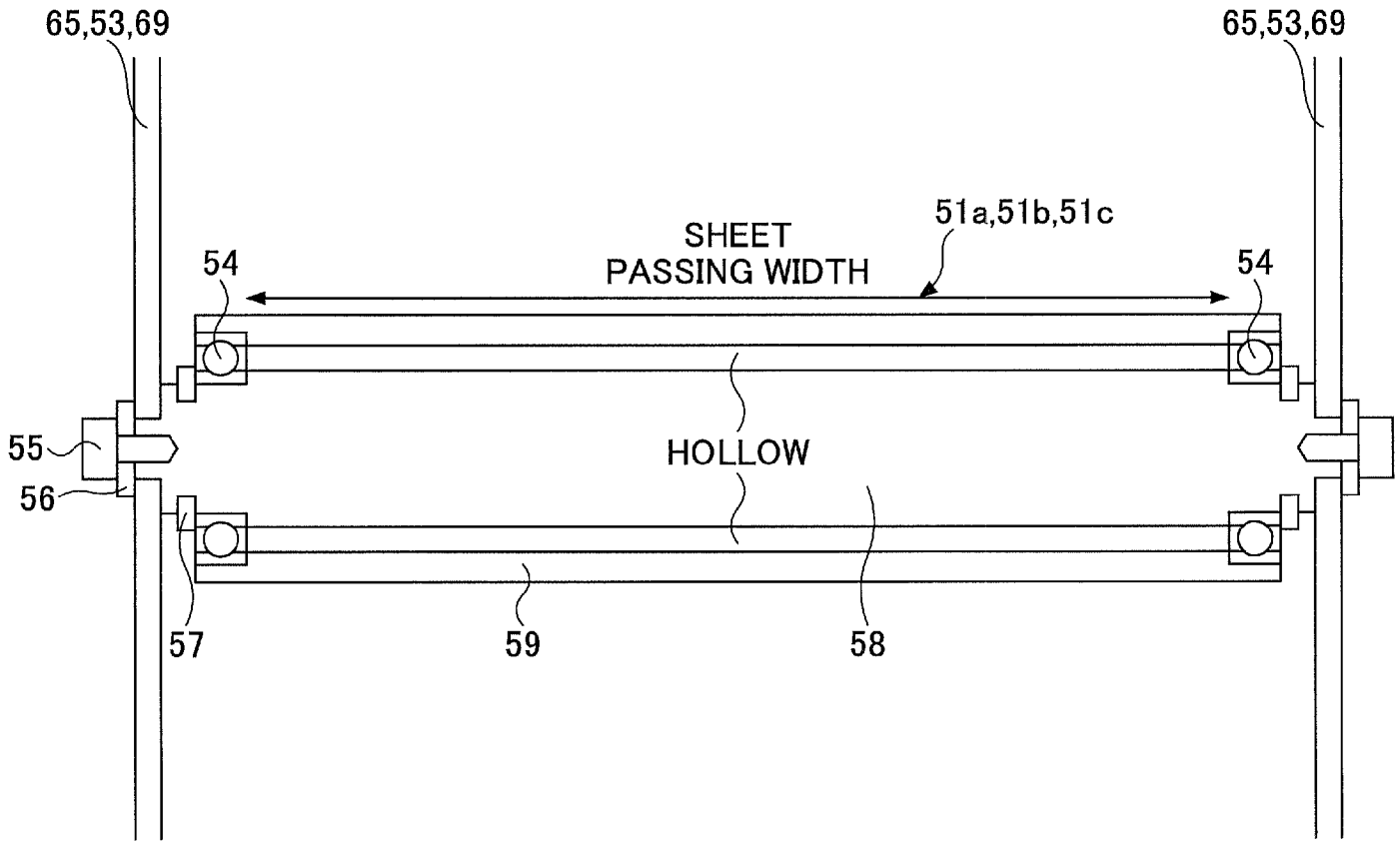
FIG. 7 is an enlarged view of a configuration example of a driven roller in a cockling suppressing mechanism.

Here, FIG. 7 is a cross-sectional view of a configuration example of the hollow driven roller 51 constituting the cockling suppressing mechanism 90. In each of the driven rollers 51*a*, 51*b*, 51*c*, bearings 54 are fit to a shaft 58 and hollow roller 59, E rings 57 are used as stoppers, and washers 56 and bolts (screws) 55 are used for fixing the driver roller 51 to a holder 65, a frame 53, and a plate 69 (see FIG. 10). The internal diameter of the hollow roller 59 is larger than the external diameter of the shaft 58, and the space between the surface on the inner side of the hollow roller 59 and the outer side of the shaft 58 is hollow.

The hollow roller 59 may be made of stainless steel that is resistant to erosion, or aluminum that has a relatively high degree of heat conductivity. In order to increase the detachability, similar to the heating rollers 4*a* through 6*b*, the surfaces of the driven rollers 51 may be coated by a non-viscous film, such as fluorocarbon resin, for suppressing the adhesion of the pretreatment liquid and ink on the roller surface; however, the present embodiment is not so limited.

As the heated recording medium 10 passes along the outer surface of the hollow roller 59 while winding around the hollow roller 59, the hollow roller 59 receives heat from the recording medium 10. At this time, in order to prevent the heat from being transmitted at inhomogeneous temperatures, a sheet passing width is set on the hollow roller 59 by avoiding the parts of the bearings 54 where the heat conductivity is different. By the above configuration, it is possible to transmit homogeneous heat from the recording medium 10 to the inside of the hollow roller 59 (hollow part), in the width direction of the recording medium 10.

Note that the driven roller 51 preferably has a hollow part; however, the hollow roller is not limited to the above configuration. For example, the ratio of the hollow part is not limited to the illustrated example; the shaft 58 may not be provided and the inside of the roller may be hollow, and furthermore, air and a cooling medium may be sent into the hollow roller.

Here, when a continuous sheet is used as the recoding medium, and the recording medium needs to be set to exchange the sheet type or because the device is out of paper, the device needs to be opened to pass the sheet through the device. When the user sets the recording medium in such a device, and the sheet passing path through which the recording medium passes is pressurized, or a member is disposed across the path, the operation of inserting the recording medium becomes complicated, and therefore the operability in setting a recording medium may be degraded. Furthermore, when the user needs to directly touch a member inside the device to move the member in order to pass the recording medium through the device, safety may be degraded.

Therefore, according to the present embodiment, by constituting the heating drying device and the cockling suppressing mechanism as follows, the above problems can be solved.

Figure 8:
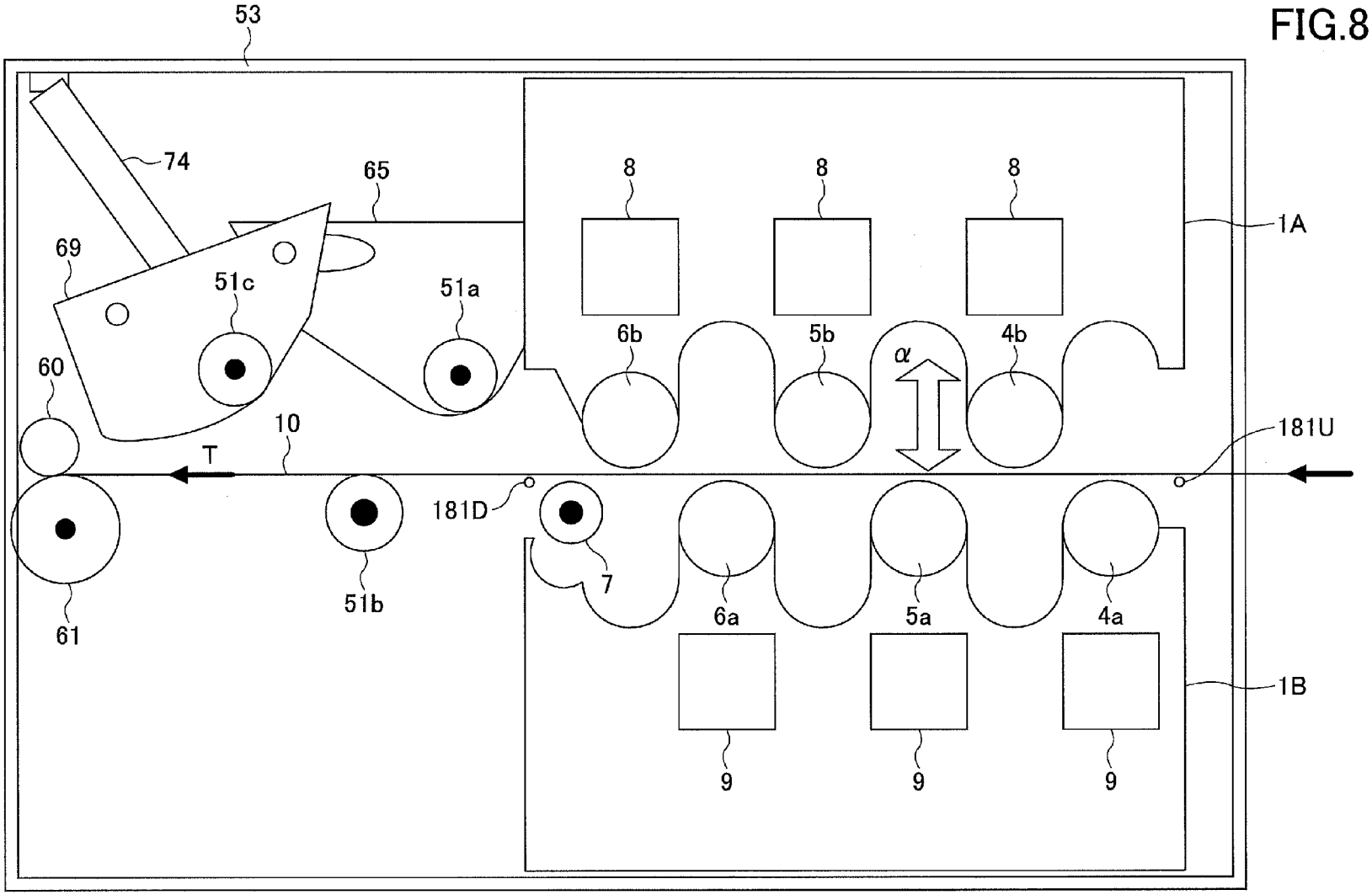
FIG. 8 is a cross-sectional view of a state where the heating drying device illustrated in FIG. 6 is open vertically such that a front side drying unit and a back side drying unit are separated for loading a recording medium.

FIG. 8 is a cross-sectional view of a state where the heating drying device 1 illustrated in FIG. 6 is open vertically. The front side drying unit 1A and the back side drying unit 1B are connected in a separable manner with each other (connected in close contact). FIG. 8 illustrates an open state where the front side drying unit 1A and the back side drying unit 1B are separated from each other. The front side drying unit 1A (first drying unit) and the back side drying unit 1B (second drying unit) can be moved between a closed state (connected state) illustrated in FIG. 6 and an open state (separated state) illustrated in FIG. 8.

For example, when changing the type of the recording medium 10, when the device is out of roll paper, or when a paper jam has occurred, there is a need to load the recording medium. When loading the recording medium 10, first, the front side drying unit 1A and the back side drying unit 1B are moved in directions to be separated from each other into the open state illustrated in FIG. 8, and the recording medium 10 is inserted through between the front side drying unit 1A and the back side drying unit 1B. After passing the recording medium 10 through, the front side drying unit 1A and the back side drying unit 1B are moved in directions to be in close contact with each other, such that the front side drying unit 1A and the back side drying unit 1B are in the closed state illustrated in FIG. 6. Also when the recording medium 10 is moved, the heating drying device 1 is opened and closed in the same manner.

Here, assuming that when the front side drying unit 1A is moved upward to open the heating drying device 1, and the positions of the driven rollers 51*a* through 51*c* are fixed in the cockling suppressing unit 50, it may not be possible to properly pass the recording medium 10 above and under the driven rollers 51*a* through 51*c*. Alternatively, creases may be formed in the recording medium 10 when passing the recording medium 10 through.

Thus, in the cockling suppressing mechanism according to an embodiment of the present invention, some of the plurality of driven rollers included in the cockling suppressing mechanism are movable in the upward direction in conjunction with the upward movement of the front side drying unit 1A when the heating drying device 1 is opened. In the present example, the driven roller 51*a* disposed at the holder 65 and the driven roller 51*c* disposed at the plate 69 move in conjunction with the upward movement of the front side drying unit 1A. Therefore, the recording medium 10, which is conveyed in the conveying direction indicated by an arrow T, can be easily loaded. In the following, a detailed description of movements of the cockling suppressing mechanism 90 is given.

(Configuration Example of Link Mechanism)

Figure 9:
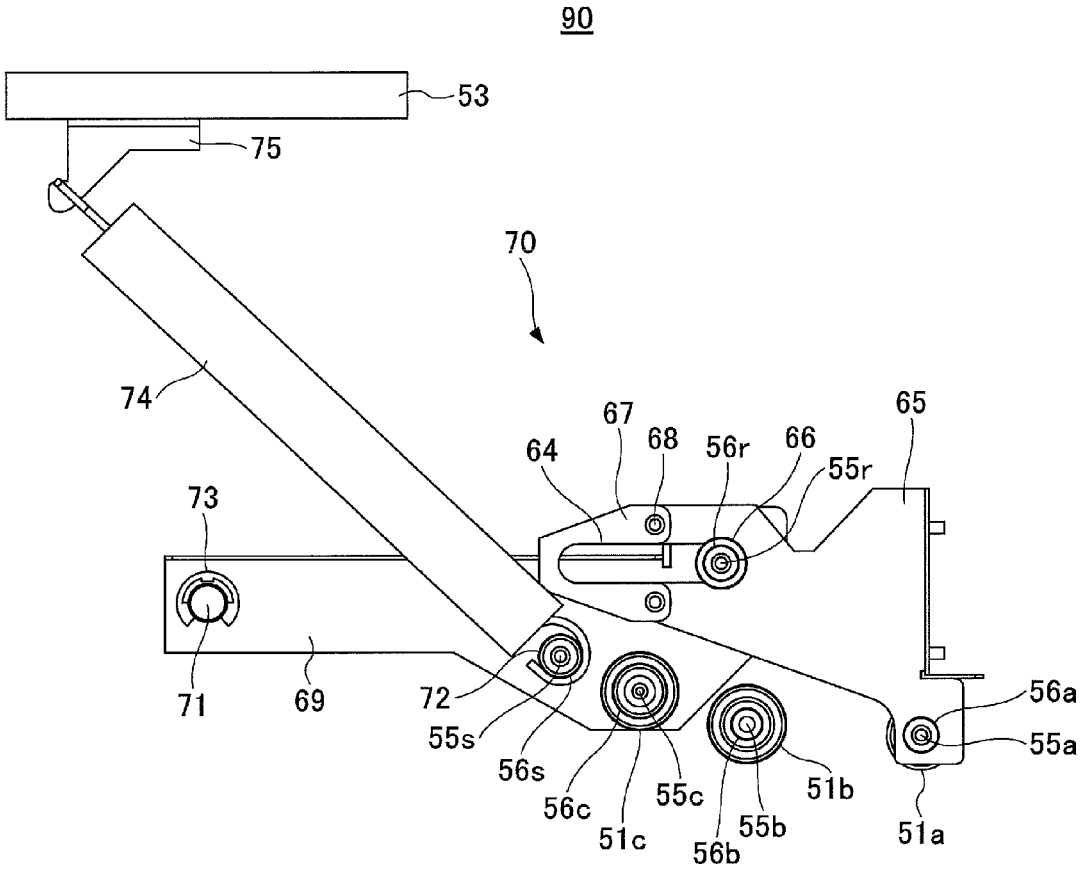
FIG. 9 is a side view of a link mechanism of the cockling suppressing mechanism.
Figure 10:
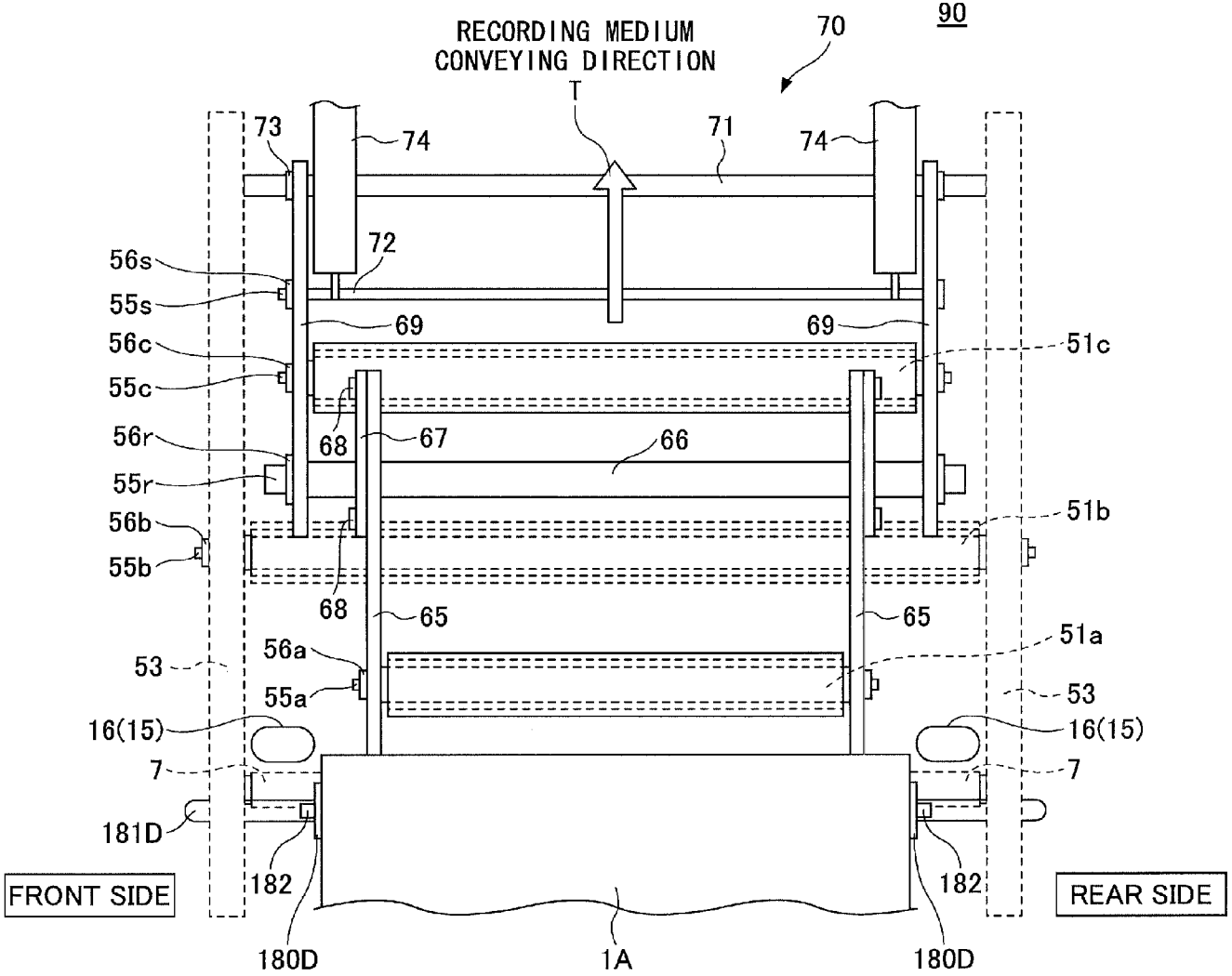
FIG. 10 is a top view of the cockling suppressing mechanism.

FIG. 9 is a side view of the link mechanism 70 of the cockling suppressing mechanism 90. FIG. 10 is a top view of the cockling suppressing mechanism 90.

The cockling suppressing mechanism 90 includes the holder 65, the plate 69, a link shaft 66, and a support spring 74, as the link mechanism 70 for supporting and moving the positions of the driven rollers 51*a* and 51*c* described above. The holder 65 and the plate 69, which are a supporting member, are connected to each other, and move by being linked to each other, and therefore the shape of the link mechanism 70 can change in shape in accordance with the movements of the holder 65 and the plate 69.

The holder 65, which supports the driven roller 51*a* (hollow roller), is fixed to the front side drying unit 1A that moves upward when the heating drying device 1 is opened. To the holder 65, the driven roller 51*a* is attached, and the driven roller 51*a* is fixed by screws 55*a* and washers 56*a*. In the holder 65, a groove part 64 is formed, and a stopper plate 67 in which part of the groove part 64 is formed, is fixed to the holder 65 by screws 68. The link shaft 66 is passed through the groove part 64 of the holder 65, and the stopper plate 67 is fixed to the holder 65, and therefore the link shaft 66 is prevented from coming off the groove part 64. The driven roller 51*b*, which is on the downstream side of the driven roller 51*a* in the recording medium conveying direction, is attached to the outside frame 53 as illustrated in FIG. 10, and is fixed by screws 55*b* and washers 56*b*. Note that the driven roller 51*b* may not be fixed at this position, when there is a frame with which the back side drying unit 1B moves in conjunction in the heating drying device 1.

To the plate 69, the driven roller 51*c* that is a hollow roller is fixed by screws 55*c* and washers 56*c*. The link shaft 66 is fixed to the plate 69 by screws 55*r* and washers 56*r*.

Furthermore, to the plate 69, a spring shaft 72 is attached by screws 55*s* and washers 56*s*. Furthermore, a rotatable shaft 71 is fixed to the plate 69 by E rings 73. The plate 69 is rotatable around the rotatable shaft 71. When the plate 69 rotates, the link shaft 66 slidably moves in the groove part 64.

The support spring 74, which is an elastic member, is hooked to a hook 75 that is fixed to the frame 53 and the spring shaft 72. By disposing the support spring 74, no matter which position the front side drying unit 1A is stopped at, the front side drying unit 1A can stop at that position while maintaining the weight balance of the link mechanism 70 and the driven rollers 51*a* and 51*c*. Furthermore, when opening and closing the heating drying device 1, in order to support the movement the front side drying unit 1A, the operation force needed for the opening and closing may be reduced.

Note that in an embodiment of the present invention, in the heating drying device 1, the front side drying unit 1A is at the top and moves in conjunction with part of the link mechanism 70; however, the back side drying unit 1B may be at the top and move in conjunction with part of the link mechanism 70 as the first drying unit.

Note that on both sides of the link mechanism 70, on the upstream side in the recording medium conveying direction, pulleys 15 are provided (see FIG. 18), around which belts 16 are wound, functioning as an opening closing assistance mechanism of the heating drying device 1.

Figure 11:
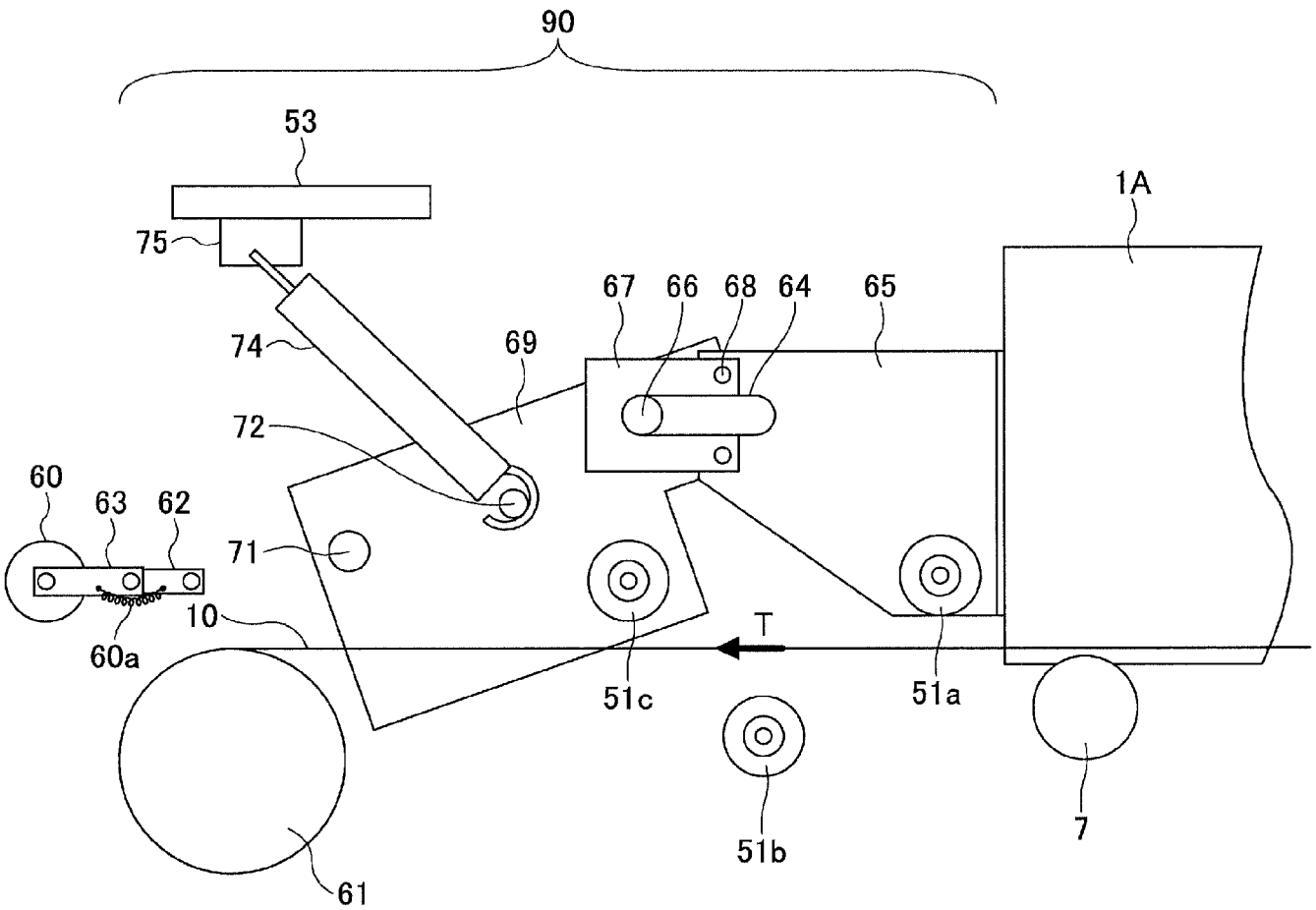
FIG. 11 is a schematic diagram of the cockling suppressing mechanism when the heating drying device of FIG. 6 is open.
Figure 12:
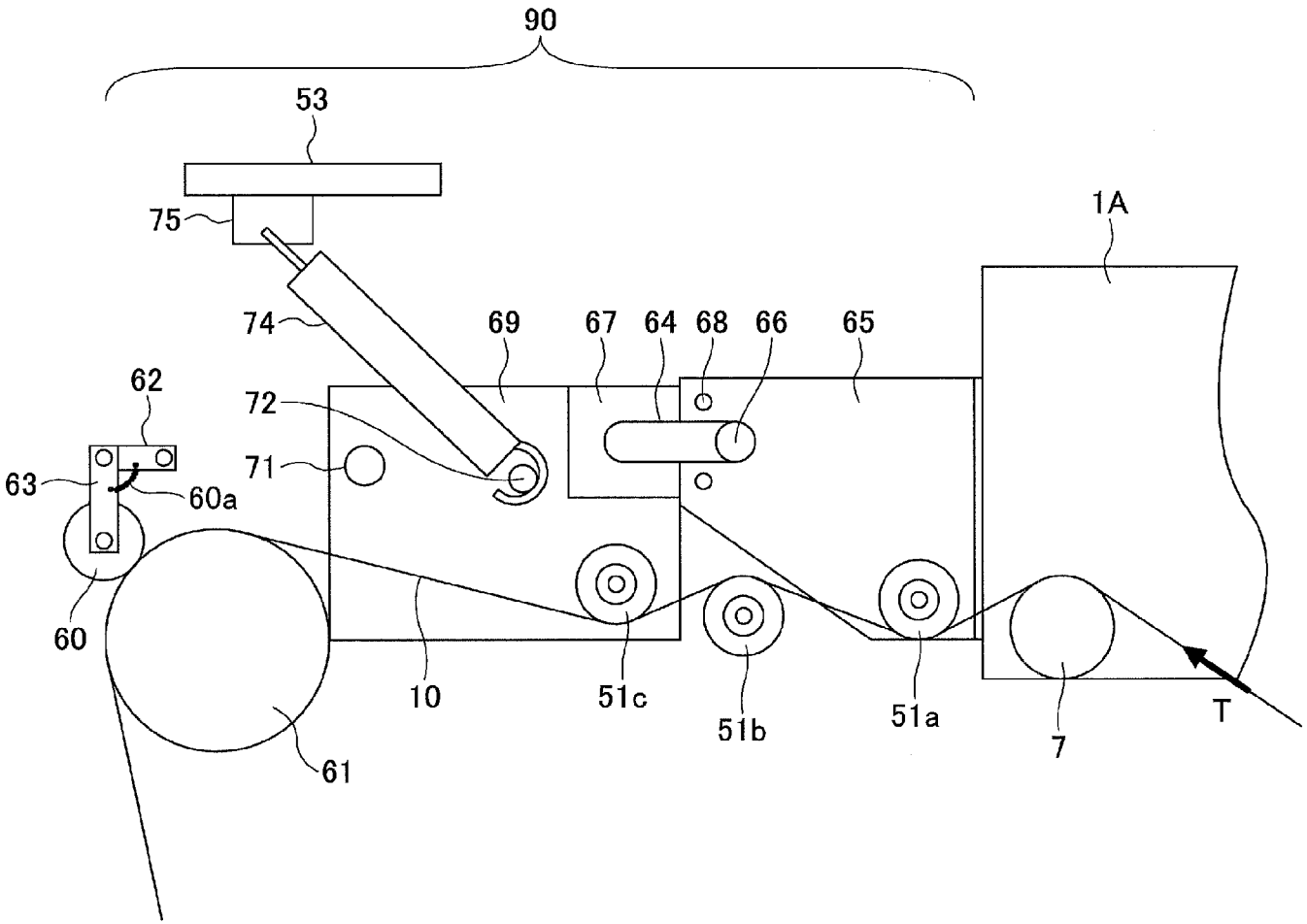
FIG. 12 is a schematic diagram of the cockling suppressing mechanism when the heating drying device of FIG. 6 is closed.

FIG. 11 illustrates a state of the cockling suppressing mechanism 90 when the heating drying device 1 is open, and FIG. 12 illustrates a state of the cockling suppressing mechanism 90 when the heating drying device 1 is closed.

In the process of opening the heating drying device 1 to be in the state of FIG. 11, the holder 65 attached to the front side drying unit 1A moves upward together with the front side drying unit 1A, and the driven roller 51*a* attached to the holder 65 also moves upward at the same time. In accordance with the movement of the holder 65, the link shaft 66 moves in the groove part 64, such that a force is applied in the direction of pushing up the plate 69. Then, the plate 69 is lifted up by using the rotatable shaft 71 as the axis, and the driven roller 51*c* attached to the plate 69 is lifted up. Thus, the driven rollers 51*a* and 51*c* move up and down in conjunction with the front side drying unit 1A.

By attaching the support spring 74 in consideration of the weight of the driven rollers 51*a* and 51*c* and the plate 69 and the gravity center position according to the movement, the operating force for opening and closing the heating drying device 1 is reduced, and no matter which position the front side drying unit 1A is stopped at, the front side drying unit 1A can stop at that position while maintaining the weight balance.

Here, the driven roller 51*b* and the idler roller 7 are fixed to the frame 53 illustrated in FIG. 10, and therefore even when the heating drying device 1 is opened or closed, the driven roller 51*b* and the idler roller 7 do not move (still). That is, the driven roller 51*b* is unaffected by the separating and connecting movements of the heating drying device 1.

Accordingly, when the heating drying device 1 is opened, the holder 65 and the plate 69 move separately, the link mechanism 70 changes in shape, and the driven rollers 51*a* and 51*c* are pulled up. Therefore, a space extending in a substantially horizontal manner for passing through the recording medium 10, is temporarily formed as a sheet passing path, and the recording medium 10 can be easily inserted through between the driven rollers 51*a*, 51*c*, and the driven roller 51*b*, of the cockling suppressing mechanism 90.

As illustrated in FIG. 11, in a state where the heating drying device 1 is open, the recording medium 10 is passed through the heating drying device 1 and the cockling suppressing mechanism 90, and subsequently, as illustrated in FIG. 12, the heating drying device 1 is closed and the link shaft 66 attached to the plate 69 is pushed down. Accordingly, the link shaft 66 moves in the groove part 64, and pushes down the plate 69. The plate 69 rotates around the rotatable shaft 71, and the driven roller 51*a* attached to the plate 69 and the driven roller 51*c* attached to the holder 65 are pushed downward.

As described above, when the heating drying device 1 is closed, a latch 180 is latched to latch pins 182, 183 and to be in a locked state, as illustrated in FIG. 10. In this state, the driven rollers 51*a* and 51*c* are disposed at predetermined positions, and the recording medium 10 is wound around the driven rollers 51*a* through 51*c* at intended angles. Therefore, after setting the recording medium 10, the driven rollers 51*a* through 51*c* can be easily set to the positions for the heating operation.

Note that the feed roller 61 and the feed nip rollers 60 at the downstream side of the cockling suppressing mechanism 90 are constituted as, for example, the FI roller 22 and the FI nip rollers 23 as illustrated in FIG. 3. The feed roller 61 is drivingly rotated by a driving source such as a motor. When the recording medium is being conveyed, the feed nip rollers 60 are pressed against the feed roller 61 by the tensile force of a spring 60*a*, which is hooked to arms 62, 63, and tension is applied to the feed roller 61. When exchanging the recording medium, by manually lifting up the arm 63, the feed nip rollers 60 are lifted up, and a sheet passing path can be formed.

(Latch Mechanism)

Figure 13:
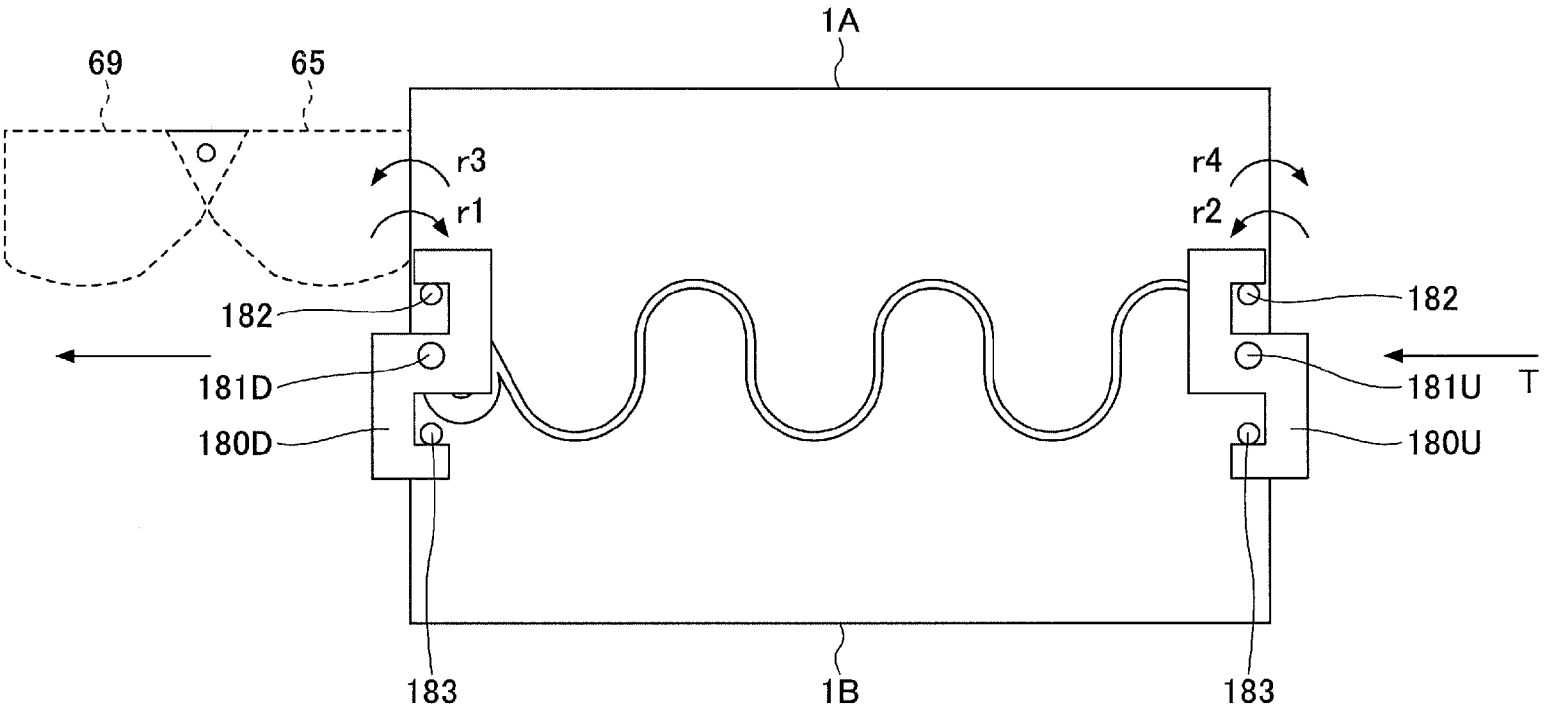
FIG. 13 illustrates a latch mechanism when the heating drying device of FIG. 6 is closed.
Figure 14:
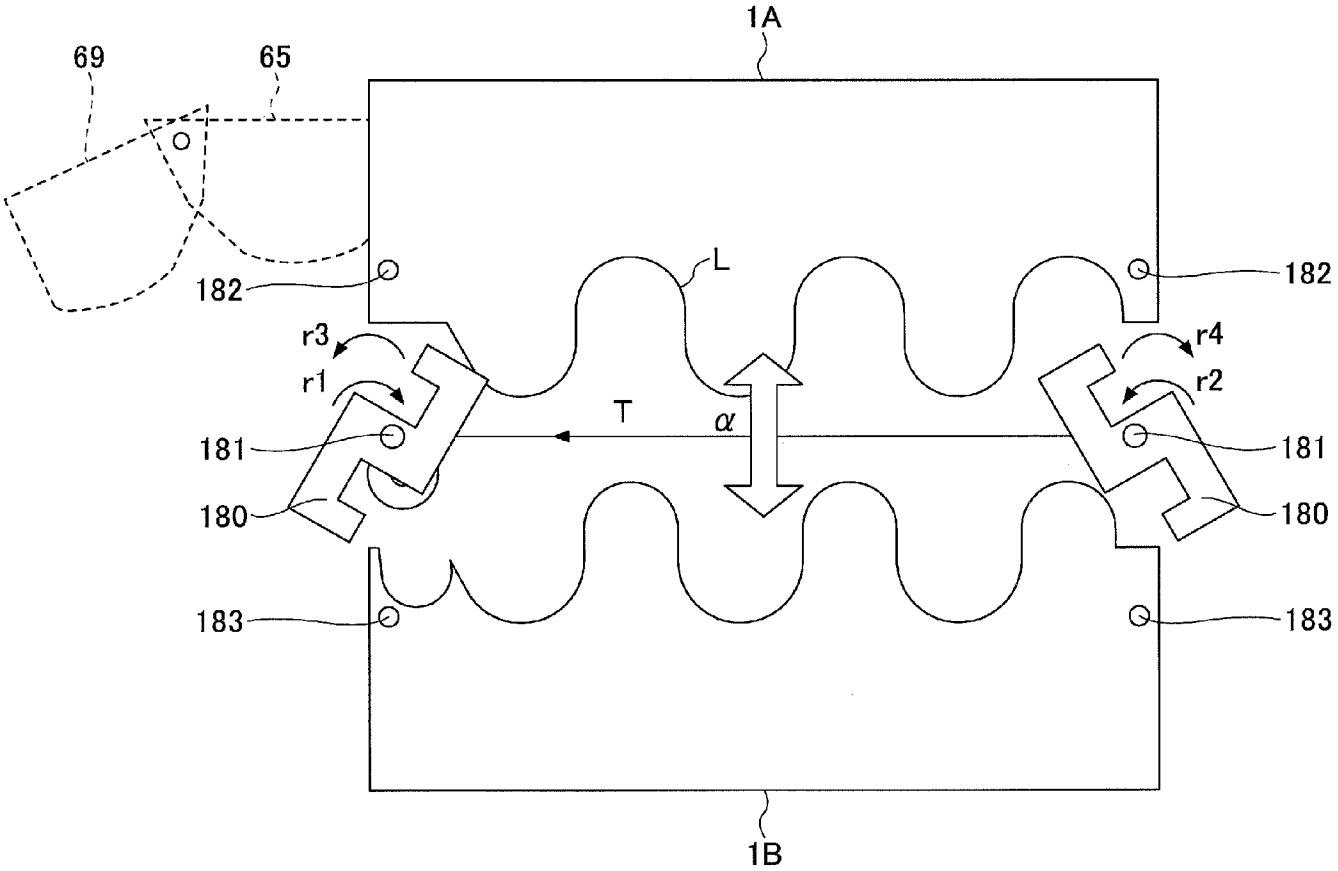
FIG. 14 illustrates the latch mechanism when the heating drying device of FIG. 6 is open.

FIGS. 13 and 14 illustrate the motion of a latch mechanism 18, as viewed from the front side when opening and closing the heating drying device 1. The latch mechanism 18 is for locking the front side drying unit 1A and the back side drying unit 1B at a connection position where these units are connected. From the state of FIG. 13, as the latches 180D and 180U of the latch mechanism 18 respectively rotate in the directions of r1 and r2, the latch 180 is unlocked. Furthermore, from the state of FIG. 14, as the latches 180D and 180U of the latch mechanism 18 respectively rotate in the directions of r3 and r4, the latch 180 is locked (returns to the state of FIG. 13).

Figure 17:
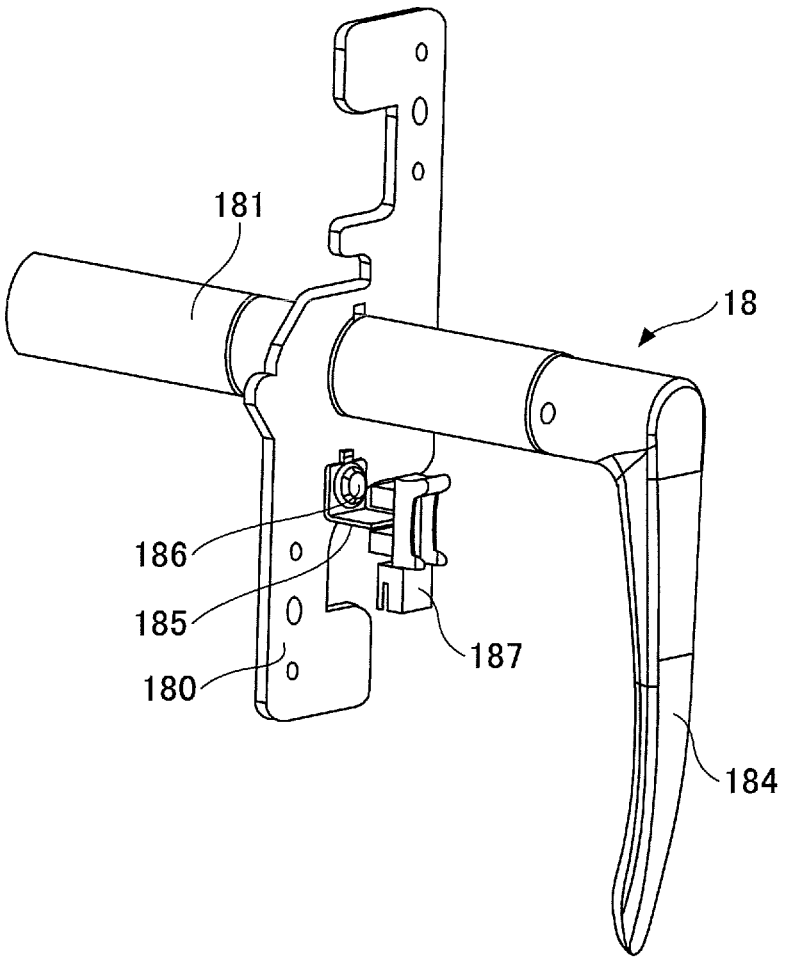
FIG. 17 illustrates a structure of a latch handle of the latch mechanism according to an embodiment of the present invention.

The latch mechanism 18 includes the latch 180 that is a latch member, a latch shaft 181, the latch pins 182, 183, and a latch handle 184 (see FIG. 17). In the following, when there is no need to distinguish between the upstream side and the downstream side in the conveying direction, U and D are omitted from the reference numerals.

FIG. 13 illustrates a state where the front side drying unit 1A and the back side drying unit 1B are connected, and the heating drying device 1 is closed. In the locked state, the latch 180 is hooked to the latch pins 182 and 183 respectively attached to the front side drying unit 1A and the back side drying unit 1B. When the latch 180 is engaged with the latch pins 182, 183, the front side drying unit 1A and the back side drying unit 1B are locked in a state where they are connected in close contact, and the heating drying device 1 will not open even during printing. Furthermore, the cockling suppressing mechanism 90 moves in conjunction with the front side drying unit 1A, and therefore the movement of the cockling suppressing mechanism 90 is restricted by the latch mechanism 18.

In FIG. 14, when the heating drying device 1 is opened, i.e., when the front side drying unit 1A and the back side drying unit 1B are separated, the latch 180 rotates in a direction to be spaced apart from the latch pins 182, 183.

By the above configuration, even when the front side drying unit 1A and the back side drying unit 1B are moved in the vertical direction (a arrow direction), the latch pins 182, 183 do not contact the latch 180. Furthermore, on the side of the front side drying unit 1A of the heating drying device 1 on the downstream side of the recording medium conveying direction, the holder 65 of the cockling suppressing mechanism 90 is attached.

Figure 15:
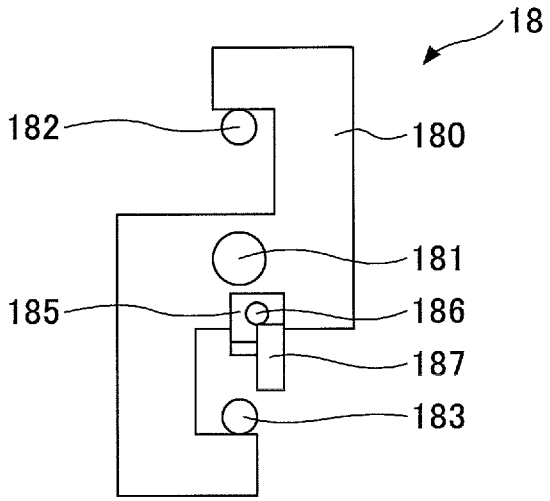
FIG. 15 is a detailed diagram of the latch mechanism when the heating drying device of FIG. 6 is closed.
Figure 16:
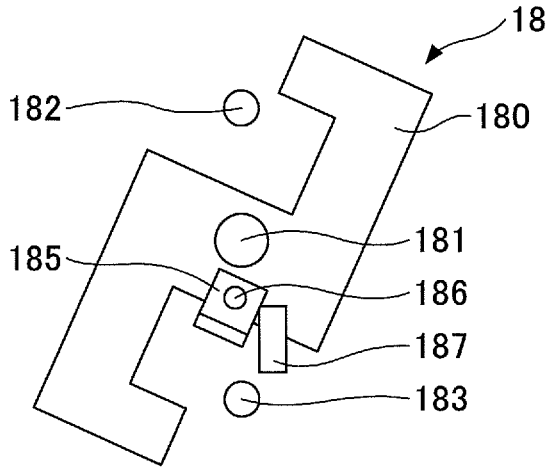
FIG. 16 is a detailed diagram of the latch mechanism when the heating drying device of FIG. 6 is open.

FIGS. 15 and 16 are enlarged views of the latch 180 (the latch 180D on the downstream side illustrated on the left side in FIGS. 13 and 14). A sensor plate 185 is fixed to the latch 180 by a screw 186. The leading end of the bent sensor plate 185 that is not fixed, is configured to enter a photo sensor 187 that is attached to, for example, the frame 53 (see FIG. 10). Depending on whether the photo sensor 187 detects the sensor plate 185, the state of the latch 180 can be detected, when locking or unlocking the latch 180 according to the rotation of the latch mechanism 18.

FIG. 15 illustrates a state where the latch 180 is locked. When the latch 180 is hooked to (engaged with) the latch pins 182, 183, the sensor plate 185 attached to the latch 180 enters the photo sensor 187 attached to the frame 53, and it is possible to detect that the latch 180 is in a locked state.

FIG. 16 illustrates a state where the latch 180 is unlocked. The latch 180 rotates around the latch shaft 181, and moves in a direction away from the latch pins 182, 183. At the same time, the sensor plate 185 attached to the latch 180 moves away from the photo sensor 187, and it is detected that the latch 180 is unlocked. In a state where the photo sensor 187 on the verge of detecting the unlocked state (in a state where the sensor plate 185 is on the verge of the position of the photo sensor 187), the latch 180 will not come off the latch pins 182, 183.

After the photo sensor 187 detects the unlocking, the latch pins 182, 183 will not come off from the latch 180 unless the latch 180 is in a further rotated state. Therefore, the latch 180 is stopped at a halfway position, and the heating drying device 1 will not open during printing. That is, the latch mechanism 18 locks the front side drying unit 1A and the back side drying unit 1B at a connected position.

Furthermore, as illustrated in FIGS. 13 and 14, latches 180 are attached on the left and right sides, and the left and right photo sensors 187 respectively detect the states of the left and right latches 180. Therefore, even when the latch 180 on one side has come off, the heating operation cannot be performed.

FIG. 17 illustrates a structure of the latch handle 184 according to an embodiment of the present invention. FIG. 17 illustrates the latch 180D disposed at the downstream side in the recording medium conveying direction in FIGS. 11 and 12. The latch handle 184, which is a latch operating unit, is connected to the latch shaft 181. By operating the latch handle 184, the latch 180 is rotated, in order to lock or unlock the above-described connected position.

For example, there are two latch handles 184 attached on the left and right sides, so as to correspond to the respective latch shafts 181, on the upstream side of the heating drying device 1. As illustrated in FIG. 10, when the latch handles 184 disposed at the downstream side in the recording medium conveying direction are operated, the two latches 180D on the front side and rear side move in conjunction with each other, via the latch shaft 181D. Furthermore, also by operating the latch handles 184 disposed at the upstream side, the two latches 180U on the front side and rear side move in conjunction with each other, via the latch shaft 181U.

Here, the opening and closing movements of the heating drying device 1 are described below with reference to FIG. 18.

(Configuration of Opening Closing Mechanism of Heating Drying Device)

FIG. 18 is a schematic diagram of the movement mechanism of opening and closing the heating drying device 1, which is a view of the heating drying device 1 from the upstream side in the conveying direction (from the right side of FIG. 6). For each of the heating rollers 4*a* through 6*b*, a thermistor 2 is provided for controlling the temperature, which is fixed to the cases of the front side drying unit 1A and the back side drying unit 1B by holders 3.

As illustrated in FIG. 18, the front side drying unit 1A is attached to the outside (on the side away from the front side drying unit 1A and the back side drying unit 1B) of each belt 16 wound around a pair of pulleys 15, via an arm 13. The back side drying unit 1B is attached to the inside (on the side near the front side drying unit 1A and the back side drying unit 1B) of each belt 16, via an arm 14.

When opening and closing the heating drying device 1, the pulleys 15 rotate. The arms 13, 14 are attached to each belt 16, which is wound around the pulleys 15. Accordingly, only a small amount of force is required, for moving the front side drying unit 1A and the back side drying unit 1B to be separated and connected. That is, the pulleys 15, the belts 16, and the arms 13, 14 form an opening closing assistance mechanism for supporting the opening and closing movements of the heating drying device 1.

In the case of a paper jam or the case of exchanging the sheet, the connection position of the heating drying device 1 is locked by the latch mechanism 18 while printing is performed, and therefore first the latch handle 184 is rotated to unlock the latch 180 (see FIGS. 13 and 14). Note that at this time, by the rotation of the latch 180, the sensor plate 185 attached to the latch 180 separates from the photo sensor 187 attached to the frame 53, and therefore it is detected that the latch 180 is unlocked.

Then, when the latch 180 is unlocked, the user pushes up any location on the bottom side (L: see FIG. 14) of the front side drying unit 1A of the heating drying device 1, and opens the heating drying device 1. At this time, as illustrated in FIG. 18, the opening and closing movements of the front side drying unit 1A and the back side drying unit 1B are supported by the belts 16 and the pulleys 15, and therefore the user can push up the front side drying unit 1A by a light force.

When the front side drying unit 1A is pushed and moved upward, the link mechanism 70 changes shape in conjunction with the movement of the front side drying unit 1A and the driven rollers 51*a* and 51*c* move up, because the holder 65, which is part of the cockling suppressing mechanism 90, is fixed to the front side drying unit 1A.

Here, when pushing up any location of the front side drying unit 1A, the front side drying unit 1A is supported by the belts 16 and the pulleys 15; however, a predetermined force would be further needed for raising part of the cockling suppressing mechanism 90 which moves in conjunction with the front side drying unit 1A.

However, in an embodiment of the present invention, in the cockling suppressing mechanism 90, the weight of the link mechanism 70 and the driven rollers 51*a* and 51*c* supported by the link mechanism 70, is supported by the support springs 74. Therefore, it is possible to reduce the operation force required for opening and closing the heating drying device 1, particularly when opening the heating drying device 1 by moving up the front side drying unit 1A against gravity.

Furthermore, when closing the heating drying device 1, the position of the front side drying unit 1A is moved, to form the curved conveying path 52 in which the plurality of driven rollers 51*a*, 51*b*, and 51*c* curve the recording medium in desired angles in the conveying direction. Then, by locking the heating drying device 1 with the latch mechanism 18, the connected state of the front side drying unit 1A and the back side drying unit 1B is restricted (fixed) at the locked position.

As described above, according to an embodiment of the present invention, by providing a cockling suppressing unit, without the need for expensive paper sheets that are exclusively used for inkjet printing, a pretreatment liquid application drying process is performed, and particularly during the standby state of the device, it is possible to significantly reduce the occurrence of wave-formed deformation and cockling which are caused by moisture absorbed by the recording medium 10 at the drying unit outlet side.

Furthermore, according to an embodiment of the present invention, by the link mechanism having the above configuration, it is possible provide a pretreatment liquid application device by which a recording medium can be safely set by simple operations.

<Second Embodiment>

Figure 19:
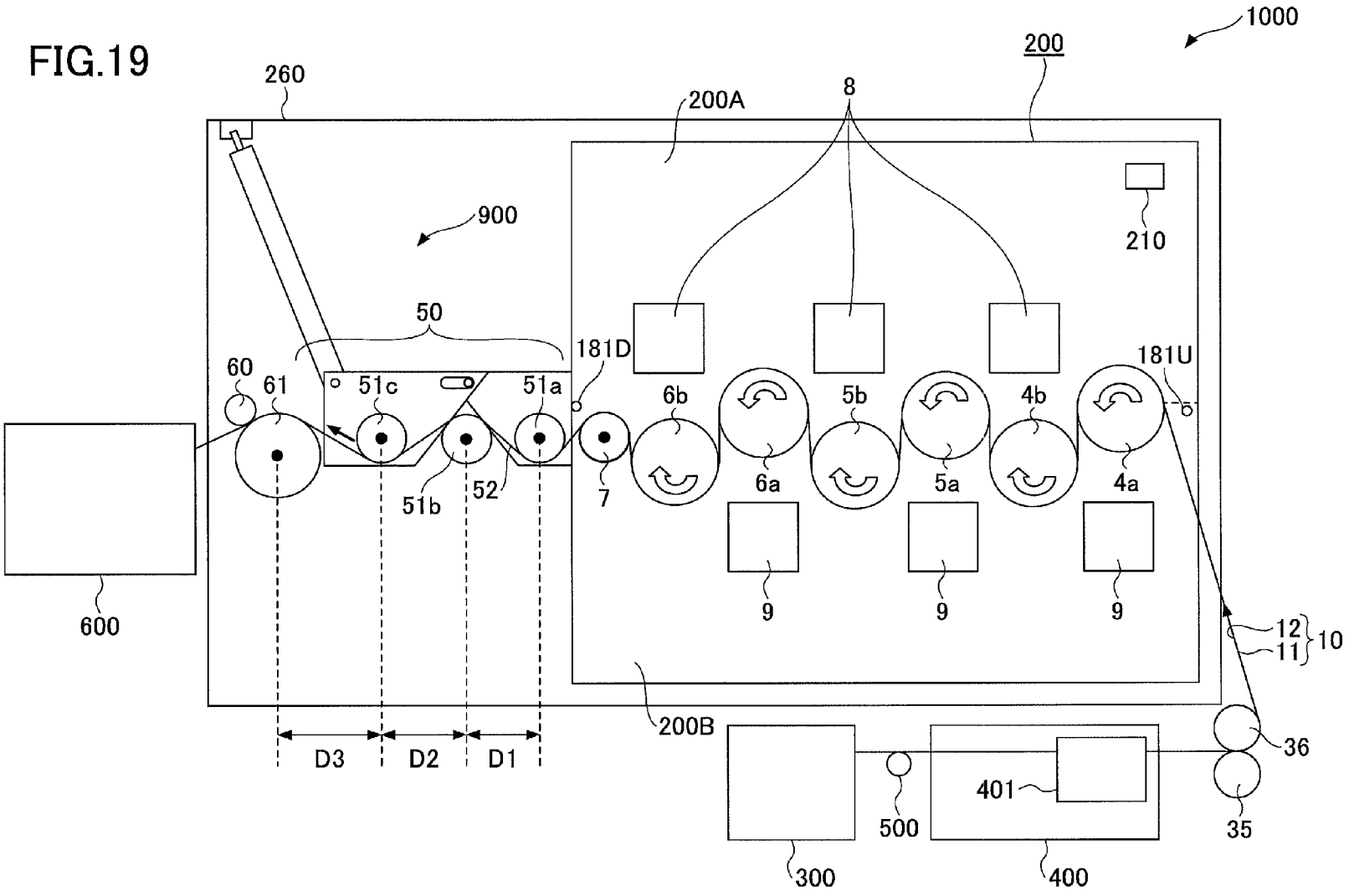
FIG. 19 illustrates an overall configuration of an inkjet printer according to a second embodiment of the present invention.

Here, FIG. 19 illustrates a printing device having a heating drying function and a cockling suppressing function.

A recording medium heating drying device 200 according to the present embodiment is an ink drying device, and a description is given of a printing device 1000 including the recording medium heating drying device 200. FIG. 19 is a schematic diagram of the entire printing device 1000 including the heating drying device 200. Note that in the following, the same elements as those of the first embodiment are denoted by the same reference numerals, and the points that are different from the first embodiment are mainly described.

As illustrated in FIG. 19, in the printing device 1000 according to the present embodiment, a recording device 400, a sheet feeding device 300, and a conveying part 500 are disposed on the upstream side of the heating drying device 200. On the downstream side of the heating drying device 200 that is an ink drying device, a cockling suppressing mechanism 900 and a posttreatment device 600 are disposed. Note that as the posttreatment device 600, a reeling device for reeling the recording medium 10 after printing and a folding device for folding the recording medium 10 after printing may be disposed.

The recording device 400 (recording device part) includes a head unit 401 that is an image forming unit. The head unit 401 discharges liquid such as ink onto the recording medium 10 such that the liquid adheres onto the recording medium 10, to form an image on the recording medium 10.

Similar to the first embodiment, the heating drying device 200 (heating drying device part) includes heating rollers 4*a*, 4*b*, 5*a*, 5*b*, 6*a*, 6*b*, from the upstream side of the conveying direction T of the recording medium 10, vapor ejection fans (exhaust ducts) 8, 9, and an eject roller (idler roller) 7. Here, the front side drying heating rollers 4*b*, 5*b*, 6*b* are provided in a front side heating unit 200A, and the back side drying heating rollers 4*a*, 5*a*, 6*a* are provided in a back side heating unit 200B. By connecting (in close contact) and separating (spacing apart) the front side heating unit 200A and the back side heating unit 200B, the heating drying device 200 can be vertically opened and closed.

Furthermore, in the heating drying device 200, a heating control process is executed by a control device 210, and the heating amount (temperature) of the heaters of the respective heating rollers 4*a* through 6*b* is controlled.

In the present embodiment also, similar to FIG. 6, the curved conveying path 52 which includes a plurality of curves in the conveying direction by the plurality of driven rollers 51, is formed on the downstream side near the outlet of the heating drying device 1. The curved conveying path 52 suppresses the cockling (ripples) in the sheet width direction that occurs during the standby state.

In the present embodiment also, similar to FIGS. 9 through 12, the cockling suppressing mechanism 900 includes the cockling suppressing unit 50 and also the link mechanism 70, and therefore the driven rollers 51*a* and 51*c* can be moved in conjunction with the front side heating unit 200A at the top part.

Here, in the printing device 1000, when the heating drying device 200 is provided independently, the heating drying device 200 and the cockling suppressing mechanism 900 (cockling suppressing mechanism part) are surrounded by a frame 260. In the link mechanism 70, the support spring 74 is connected to the frame 260.

Furthermore, in the present embodiment also, similar to FIGS. 13 through 18, the heating drying device 200 includes the latch mechanism 18, and inside the frame 260, the opening closing assistance mechanism (13, 14, 15, 16) is provided. Therefore, as described above, when operating the latch handle 184 to unlock the latch 180 and then pushing up the heating drying device 1, it is possible to open and close the link mechanism 70 and the driven rollers 51*a* and 51*c* by a light force, according to the support spring 74 and the opening closing assistance mechanism.

In the present embodiment also, without the need for expensive paper sheets that are exclusively used for inkjet printing, an ink drying process is performed, and particularly during the standby state of the device, it is possible to significantly reduce the occurrence of wave-formed deformation and cockling which are caused by moisture absorbed by the recording medium 10 at the drying unit outlet side. Therefore, it is possible to perform a printing operation without any rubbing by the recording medium 10 the posttreatment device 600 in a post process due to cockling at, and the recording medium 10 can be properly reeled.

Furthermore, according to an embodiment of the present invention, by providing the link mechanism, the recording medium can be safely set by simple operations in the heating drying device.

According to one embodiment of the present invention, a pretreatment liquid application drying device, a printing system including the same, and a printing device are provided, which are capable of preventing the occurrence of cockling in the pretreatment liquid application drying device without making the device complicated, and improving the operability and safety when setting a recording medium.

The pretreatment liquid application drying device, the printing system including the same, and the printing device are not limited to the specific embodiments described herein, and variations and modifications may be made without departing from the spirit and scope of the present invention.

The present application is based on and claims the benefit of priority of Japanese Priority Patent Application No. 2014-251518, filed on Dec. 12, 2014, the entire contents of which are hereby incorporated herein by reference.

What is claimed is:

1. A pretreatment liquid application drying device comprising:

a conveying unit configured to convey a recording medium that is a continuous sheet;

an application device configured to apply a pretreatment liquid on the recording medium conveyed by the conveying unit;

a heating drying device disposed at a downstream side of the application device in a conveying direction of the recording medium, the heating drying device including a first drying unit and a second drying unit that are connected with each other in a separable manner, the first drying unit including a first heating unit configured to dry one side of the recording medium and the second drying unit including a second heating unit configured to dry another side of the recording medium; and a cockling suppressing mechanism including a plurality of non-heating rollers that are configured to curve the heated recording medium a plurality of times in the conveying direction, the cockling suppressing mechanism being provided on at least one of an upstream side and a downstream side in the conveying direction near the heating drying device, wherein a part of the cockling suppressing mechanism moves in conjunction with a separating and connecting movement of the heating drying device.

2. The pretreatment liquid application drying device according to claim 1, wherein the cockling suppressing mechanism includes a plurality of driven rollers, when the first drying unit and the second drying unit are connected, the plurality of driven rollers are arranged in the conveying direction such that a curved conveying path, which curves the recording medium in the conveying direction, is formed, and at least two of the plurality of driven rollers move vertically in conjunction with the first drying unit, and another one of the plurality of driven rollers, which is different from the at least two of the plurality of driven rollers, does not move during the separating and connecting movement of the heating drying device.

3. The pretreatment liquid application drying device according to claim 2, wherein the cockling suppressing mechanism includes a link mechanism including a plurality of supporting members supporting the at least two of the plurality of driven rollers that move vertically in conjunction with the first drying unit, the plurality of supporting members are connected to each other, and the link mechanism changes in shape when the first drying unit moves.

4. The pretreatment liquid application drying device according to claim 3, wherein the cockling suppressing mechanism includes an elastic member configured to adjust a weight balance of the link mechanism and the at least two of the plurality of driven rollers that move vertically in conjunction with the first drying unit, the elastic member being connected to one of the plurality of supporting members of the link mechanism.

5. The pretreatment liquid application drying device according to claim 4, wherein positions of the at least two of the plurality of driven rollers that move vertically in conjunction with the first drying unit, are adjusted by moving the first drying unit, such that the plurality of driven rollers form a curved conveying path that causes the recording medium to be curved in a desired angle in the conveying direction.

6. The pretreatment liquid application drying device according to claim 1, wherein the heating drying device includes a latch mechanism configured to lock the first drying unit and the second drying unit at a connection position where the first drying unit and the second drying unit are connected, and the cockling suppressing mechanism is restricted from moving by the latch mechanism.

7. A printing system comprising:

the pretreatment liquid application drying device according to claim 1; and a recording device configured to discharge ink on the recording medium such that the ink adheres on the recording medium, after the pretreatment liquid application drying device has applied the pretreatment liquid on the recording medium and has dried the pretreatment liquid on the recording medium, the recording device being disposed at a downstream side of the pretreatment liquid application drying device in the conveying direction.

8. A printing device comprising:

a conveying part configured to convey a recording medium;

a recording device part configured to discharge ink on the recording medium such that the ink adheres on the recording medium;

a heating drying device part disposed at a downstream side of the recording device part in a conveying direction of the recording medium, the heating drying device part including a first drying unit and a second drying unit that are connected with each other in a separable manner, the first drying unit including a first heating unit configured to dry one side of the recording medium and the second drying unit including a second heating unit configured to dry another side of the recording medium; and a cockling suppressing mechanism part including a plurality of non-heating rollers that are configured to curve the recording medium a plurality of times in the conveying direction, the cockling suppressing mechanism part being provided on at least one of an upstream side and a downstream side in the conveying direction near the heating drying device part, wherein a part of the cockling suppressing mechanism part moves in conjunction with a separating and connecting movement of the heating drying device part.

9. The pretreatment liquid application drying device according to claim 1, wherein the part of the cockling suppressing mechanism also includes the non-heating roller and moves in conjunction with the separating and connecting movement of the heating drying device.

* * * * *